US009289658B1

(12) United States Patent
Murphy, Jr.

(10) Patent No.: US 9,289,658 B1
(45) **Date of Patent: *Mar. 22, 2016**

(54) SPORTS RACKETS AND RACKET HANDLES

(71) Applicant: H. Stetser Murphy, Jr., Marietta, GA (US)

(72) Inventor: H. Stetser Murphy, Jr., Marietta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/623,312

(22) Filed: Feb. 16, 2015

(51) Int. Cl.
*A63B 49/08* (2015.01)

(52) U.S. Cl.
CPC ..... *A63B 49/08* (2013.01)

(58) Field of Classification Search
CPC . A63B 49/08; A63B 59/0014; A63B 59/0025
USPC ..... 473/549, 551; D21/756
See application file for complete search history.

(56) References Cited

U.S. PATENT DOCUMENTS

| | | | | |
|---|---|---|---|---|
| 1,638,454 | A | 8/1927 | Papin | |
| 2,166,044 | A | 7/1939 | Lewthwaite | |
| D125,473 | S | 2/1941 | Karoff | |
| D196,268 | S | 9/1963 | Lamb | |
| D247,189 | S | 2/1978 | Charpentier | |
| 4,174,109 | A | 11/1979 | Gaiser | |
| 4,438,925 | A | 3/1984 | Lindstrom | |
| 4,736,950 | A | 4/1988 | Doyle | |
| D307,930 | S | 5/1990 | Sokol et al. | |
| 4,964,645 | A * | 10/1990 | Lai | A63B 49/08 473/551 |
| 5,294,117 | A | 3/1994 | Huang | |
| 5,316,316 | A * | 5/1994 | Lai | A63B 49/08 473/538 |
| D355,232 | S | 2/1995 | Hodges | |
| 5,492,324 | A | 2/1996 | Hagey | |
| D378,389 | S | 3/1997 | Manu | |
| D380,244 | S | 6/1997 | Naumoff | |
| 5,671,926 | A | 9/1997 | Hagey | |
| D394,094 | S | 5/1998 | Davis et al. | |
| D477,645 | S | 7/2003 | Vito | |
| D484,206 | S | 12/2003 | Udwin et al. | |
| D484,556 | S | 12/2003 | Udwin et al. | |
| D488,844 | S | 4/2004 | Szelenyi | |
| 8,012,043 | B2 * | 9/2011 | Emberger | A63B 49/08 473/349 |
| 8,298,101 | B2 | 10/2012 | Babolat | |
| D703,779 | S | 4/2014 | Budacsek | |
| D716,885 | S | 11/2014 | Murphy, Jr. | |
| D726,268 | S | 4/2015 | Murphy, Jr. | |
| D726,269 | S | 4/2015 | Murphy, Jr. | |
| D731,015 | S * | 6/2015 | Murphy, Jr. | A63B 49/08 D21/756 |
| 2002/0086747 | A1 * | 7/2002 | Hsu | A63B 49/02 473/520 |

* cited by examiner

*Primary Examiner* — Raleigh W Chiu
(74) *Attorney, Agent, or Firm* — McGurk Intellectual Property Advisors

(57) ABSTRACT

Sports rackets and handles for rackets are set forth in the present disclosure. The sports rackets comprise heads with handles attached thereto, wherein the handles are beveled and include shoulders that flare outward from the sides of the handle.

37 Claims, 33 Drawing Sheets

SPORTS RACKETS AND RACKET HANDLES

TECHNICAL FIELD

The present disclosure is directed generally to sports rackets, and, more particularly, to sports racket handles.

BACKGROUND

Sports rackets, such as tennis, squash, badminton and racket ball rackets, generally include elongated handles having constant longitudinal widths. The racket handles comprising constant longitudinal widths lack the contours that can provide a more comfortable, controlled grip to the user, thereby increasing the chance of fatigue during extended use and reducing the user's ability to optimize the power and control that is imparted from the user's hand through the handle and the racket head to the game ball or shuttlecock. Consequently, there is a need for sports rackets with handles that provide varying longitudinal widths that address one or more of the deficiencies that arise in conventional racket handles.

SUMMARY

The present disclosure encompasses a sports racket comprising a frame that has a first face side, a second face side, a first edge side, and a second edge side, wherein the frame further comprises a head with a hoop formed therein and a handle connected to the head. The handle comprises an elongated handle body comprising a plurality of bevels formed thereon, with the elongated handle body comprising a width, a length, a top half portion disposed proximal to the head and a bottom half portion disposed distal to the head. The elongated handle body further comprises a first flared shoulder disposed on the first edge side and a second flared shoulder disposed on the second edge side, wherein both the first flared shoulder and the second flared shoulder extend along at least 25% of the length of the elongated handle body, and wherein at least a portion of the bottom half portion of the elongated handle body is wider than at least a portion of the top half portion of the elongated handle body. In another aspect, the sports racket of the present disclosure can comprise a first flared shoulder and a second flared shoulder both of which extend along at least 35% of the length of the elongated handle body. Additionally, both the first flared shoulder and the second flared shoulder can extend along at least 50% of the length the elongated handle body. In another aspect, both the first flared shoulder and the second flared shoulder extend along at least 80% of the length of the elongated handle body. In yet another aspect, the elongated handle body can further comprise a first lobe disposed along the first edge side and a second lobe disposed along the second edge side. In yet another aspect, the elongated handle body further can comprise a waist. In one aspect, the handle further can comprise a base cap attached to the elongated handle body, wherein the waist is disposed adjacent the base cap. The elongated handle body of the sports racket of the present disclosure also can comprise a neck disposed along the top half portion of the handle body. In one aspect, the neck can be disposed between the head and the first and the second side shoulders. In another aspect of the present disclosure, the plurality of bevels of the elongated handle body can consist of six bevels. In yet another aspect of the present disclosure, the plurality of bevels can consist of eight bevels. In still a further aspect, two bevels of the plurality of bevels can extend along less than 75% of the length of the elongated handle body. In yet another aspect, at least two of the plurality of bevels can be parallel to each other. In a further aspect, at least one of the plurality of bevels can be chiral and an enantiomorph of at least two of the plurality of bevels. In still another aspect, at least one of the plurality of bevels can be congruent with at least one other of the plurality of bevels.

The present disclosure also encompasses a sports racket comprising a frame comprising a first face side, a second face side, a first edge side, and a second edge side, wherein the frame comprises a head and a handle connected to the head, wherein the head comprises a hoop with an aperture formed therein, and wherein the handle comprises a top half portion proximal to the head and a bottom half portion distal from the head, wherein the handle further comprises a first face bevel disposed on the first face side of the frame, a second face bevel disposed on the second face side of the frame, a first intermediate bevel adjoining the first face bevel and extending toward the first edge side of the frame, a second intermediate bevel adjoining the first face bevel and extending toward the second edge side of the frame, a third intermediate bevel adjoining the second face bevel and extending toward the second edge side of the frame, and a fourth intermediate bevel adjoining the second face bevel and extending toward the first edge side of the frame, wherein the first intermediate bevel extends along both the top half portion and the bottom half portion of the handle and wherein a first portion of the first intermediate bevel disposed along the bottom half portion of the handle is wider than a second portion of the first intermediate bevel disposed along the top half portion of the handle, and wherein the second intermediate bevel extends along both the top half portion of the handle and the bottom half portion of the handle and wherein a first portion of the second intermediate bevel disposed along the bottom half portion of the handle is wider than a second portion of the second intermediate bevel disposed along the top half portion of the handle. In another aspect, the handle further can comprise a first edge bevel disposed along the first edge side of the frame and aligned between the first intermediate bevel and the fourth intermediate bevel. In an additional aspect, the handle further can comprise a second edge bevel disposed along the second edge side of the frame and aligned between the second intermediate bevel and the third intermediate bevel. In still another aspect, a portion of the first edge bevel can be aligned parallel to a portion of the second edge bevel. In yet another aspect, a portion of the first edge bevel can be aligned nonparallel to the second edge bevel. In another aspect, the first face bevel can be aligned parallel to the second face bevel. In yet another aspect, the third intermediate bevel can extend along both the top half portion of the handle and the bottom half portion of the handle and wherein a first portion of the third intermediate bevel disposed along the bottom half portion can be wider than a second portion of the third intermediate bevel disposed along the top half portion of the handle, and wherein the fourth intermediate bevel can extend along both the top half portion of the handle and the bottom half portion of the handle, and wherein a first portion of the fourth intermediate bevel disposed along the bottom half portion is wider than a second portion of the fourth intermediate bevel disposed along the top half portion of the handle. In another aspect, a portion of the first intermediate bevel can be adjacent a portion of the fourth intermediate bevel. In yet another aspect, a portion of the second intermediate bevel can be adjacent a portion of the third intermediate bevel. In a further aspect, the handle can comprise a first edge bevel disposed along the first edge side of the frame and aligned between the first intermediate bevel and the fourth intermediate bevel. In yet another aspect, the handle further can comprise a second edge bevel disposed along the second edge side of the frame and aligned between the second intermediate bevel and the third intermediate bevel. In still a further aspect, the first edge bevel can be aligned parallel to the second edge bevel. In yet another aspect, the handle further can comprise a first lobe disposed along the first edge side and a second lobe disposed along the second edge side. In another aspect, the handle can comprise a waist. In a further aspect, the first intermediate bevel can be chiral and an enantiomorph of the second intermediate bevel. In yet another aspect, the first intermediate bevel can be chiral and an enantiomorph of the fourth intermediate bevel. In yet another aspect, the first intermediate bevel can be congruent with the third intermediate bevel. In another aspect, the first intermediate bevel can be chiral and an enantiomorph of the second and the fourth intermediate bevels, and wherein the first intermediate bevel can be congruent with the third intermediate bevel. In another aspect, the second intermediate bevel can be congruent with the fourth intermediate bevel. In a further aspect, the handle can comprises a neck disposed along the top half portion of the handle.

The present disclosure also encompasses handles that are attachable to sports rackets wherein the handles comprise one or more of the features of the handles set forth herein above.

These and other aspects of the present disclosure are set forth in greater detail below and in the drawings for which a brief description is provided as follows.

DETAILED DESCRIPTION

Figure 1:
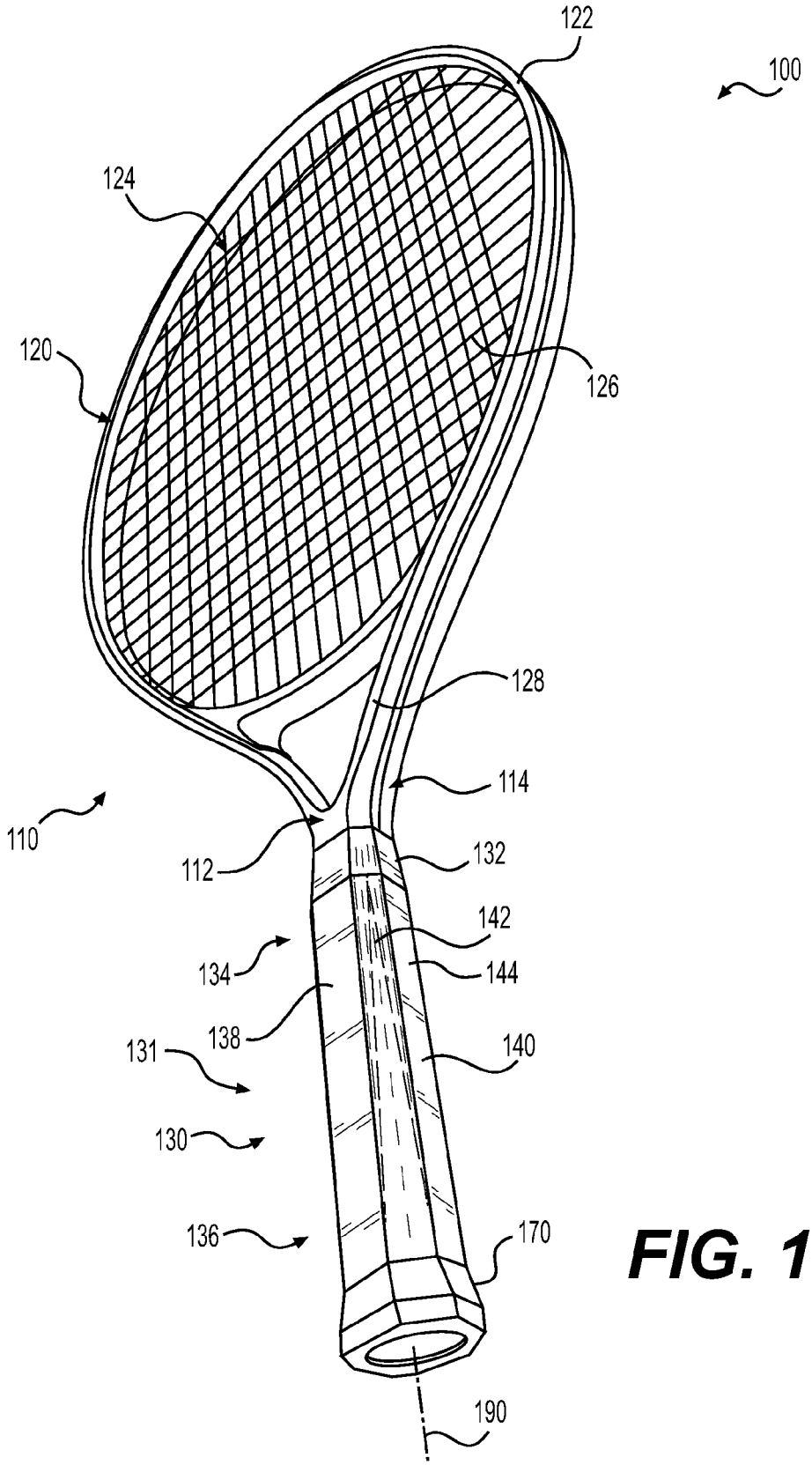
FIG. 1 is a perspective view of a sports racket encompassing aspects of the present disclosure.
Figure 2:
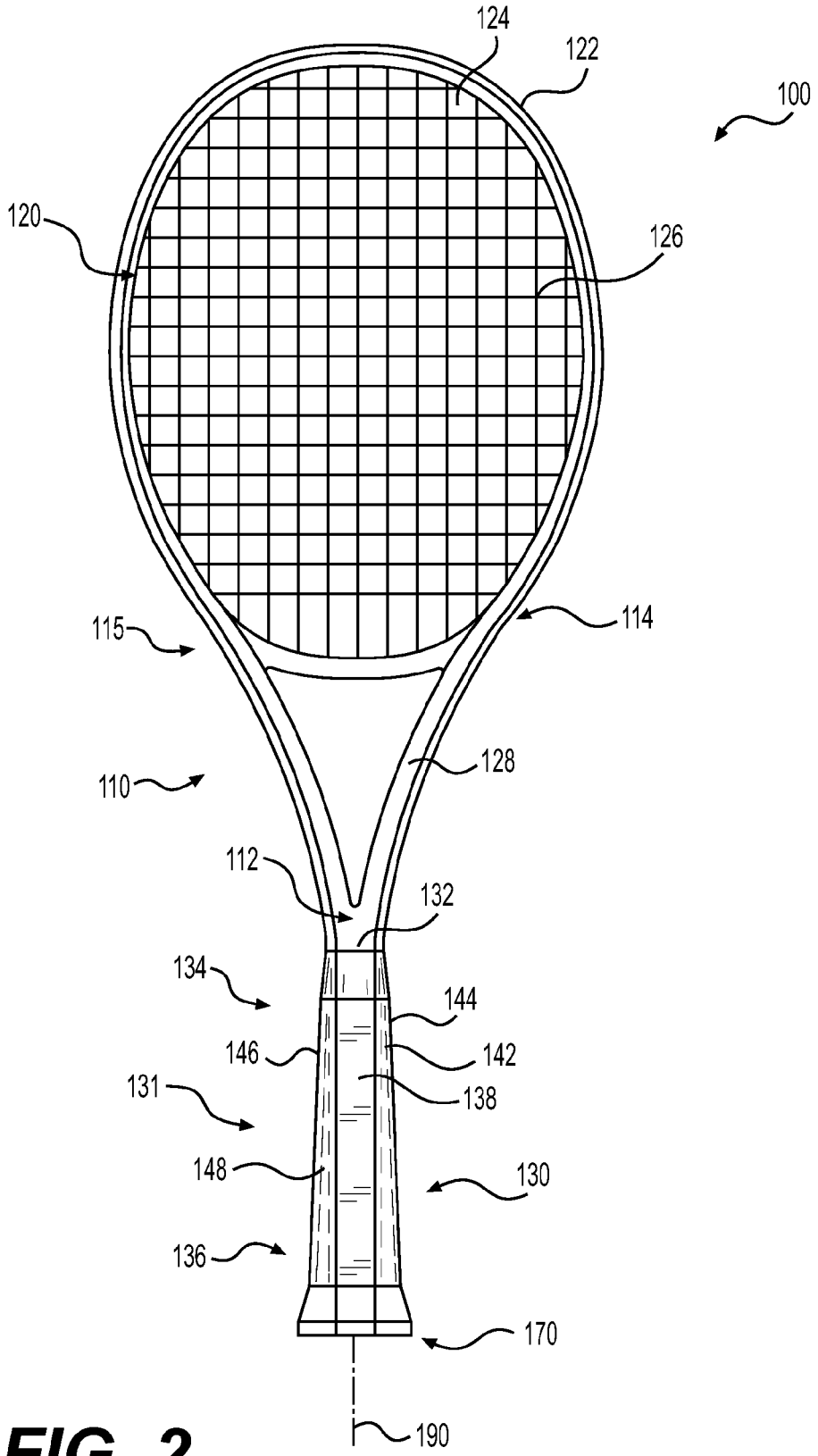
FIG. 2 is an elevation view of a first face side of the sports racket shown in FIG. 1.

The present disclosure is directed to sports rackets and handles for sports rackets. The handles of the sports rackets of the present disclosure comprise handle bodies that vary in width along a longitudinal axis extending through the body. The variations in width provide surface features by which the handles can be gripped with enhanced effect. The sports racket handles include flared portions on the edge sides thereof that provide increased surface area for a racket user to grip the racket.

As used herein, the term "bevel" refers to a surface that forms an edge with an adjacent surface and wherein the angle formed by these two adjacent surfaces does not equal 90°.

As used herein, the term "adjacent" refers to the relationship of two components in a contiguous arrangement.

As used herein, the term "hoop" refers to ring-like structure that can be either circular, or rounded but non-circular, and that defines an aperture formed therein.

As used herein, the term "face side" refers to one of the two major sides of the frame of the racket of the present disclosure, wherein the major sides are wider than the minor sides of the frame.

As used herein, the term "edge side" refers to one of the two minor sides of the racket of the present disclosure.

As used herein, the term "connected" refers to either the joining of two components in touching engagement with each other or the engagement of two components with each other via an intermediate component.

As used herein, the term "chiral" refers to an object that cannot be superimposed on its mirror image by rotations or translations alone.

As used herein, the term "enantiomorph" refers to a chiral object and its mirror image.

As used herein, the term "congruent" refers to two objects that, when superimposed, coincide at all points.

As used herein, the term "oblique" refers to a spatial relationship that is neither perpendicular nor parallel to a given line or surface.

FIGS. 1-11 show a sports racket 100 and parts thereof that encompass aspects of the present disclosure. The sports racket 100 includes a frame 110 that has a first face side 112, a second face 113, a first edge side 114, and a second edge side 115. The widest portions of the first and second face sides 112 and 113 are wider than the widest portions of the first and second edge sides 114 and 115. The first face side 112 is opposite to the second face side 113, as is the first edge side 114 opposite to the second edge side 115. The frame 110 also includes a head 120, a throat 128 and a handle 130. The head 120 is aligned at the top of the frame 110 and is connected to the handle 130 by the throat 128. The head 120 includes a hoop 122 that defines an aperture 124 that is open to both the first face side 112 and the second face side 113 of the frame 110. Across the aperture 124 are strung one or more strings 126 that connect to opposing points along the hoop 122.

The handle 130 includes a top cap 132 disposed at the top of the handle 130 proximal to the throat 128 and the head 120, a handle body 131 disposed below the top cap 132 distal to the throat 128 and the head 120, and a base cap 170 attached to the bottom half portion 136 of the handle body 131. The racket handles of the present disclosure can include a top cap 132 with various configurations. In some configurations, the top cap 132 can include a plurality of bevels, as shown in FIGS. 1-11, or, alternatively, can include a frustoconical portion that has no bevels. In some configurations, the top cap 132 is tapered outward from the throat 128 to the handle body 131. In other words, the width of the top of the top cap 132 is narrower than the base of the top cap 132, wherein the top of the top cap 132 is proximal to the head 120 of the racket 100 and the base of the top cap 132 is distal from the head 120 and adjacent to the handle body 131. The top cap 132 is distinguishable from the handle body 131 by one or more edges that extend around the bottom of the top cap 132 and delineate the surfaces of the handle body 131 from those of the top cap 132. The present disclosure also encompasses rackets that have handles that do not include top caps. The lengths of handle bodies of the racket handles of the present disclosure are longer than the lengths of the top caps and base caps combined, as measured from the top of the handle proximal to the head of the racket, to the bottom of the handle distal to the head of the racket. In one aspect, the lengths of the handle bodies of the racket handles of the sports rackets of the present disclosure are more than 60% of the total length of the racket handles. In another aspect, the lengths of the handle bodies of the racket handles of the sports rackets of the present disclosure are more than 70% of the total length of the racket handles.

The handle body 131 of handle 130 includes a top half portion 134 that is proximal to the head 120 and a bottom half portion 136 that is distal to the head 120. The top half portion 134 is proximal to the head 120 and disposed adjacent to the top cap 132 and the bottom half portion 136 is distal from the head 120 and disposed adjacent to the base cap 170. Both the top half portion 134 and the bottom half portion 136 extend one half of the distance between the bottom of the top cap 132 and the top of the base cap 170, or, in the case where there is either no top cap, no bottom cap, or both, then the distance from the top of the handle 130 proximal to the head 120 and the bottom of the handle 130 distal from the head 120. The handle body 131 comprises a plurality of bevels that forms the outer surface thereof. As shown in FIGS. 1-11, the plurality of bevels includes eight bevels that circumscribe and extend along the entire length of the handle body 131. The first face bevel 138 is formed on the handle body 131 and is aligned on the first face side 112 of the frame 110. The first face bevel 138 extends from the bottom of the top cap 132 to the top of the base cap 170. The first face bevel 138 is delineated by edges extending around the perimeter thereof. The first face bevel 138 is a rectangle with a width extending across a portion of the first face side 112 of the frame 110 and a length extending between the top cap 132 and the base cap 170. The sports rackets encompassed by the present disclosure also can include racket handles that have one or more bevels that are non-planar or that have non-planar or three-dimensional features.

The first edge bevel 140 is formed on the handle body 131 and is disposed along the first edge side 114 of the frame 110. The first edge bevel 140 extends the entire length of the handle body 131 from the bottom of the top cap 132 to the top of the base cap 170 and extends through both the top half portion 134 and the bottom half portion 136 of the handle body 131. The first edge bevel 140 is delineated by edges extending around the perimeter thereof. The first edge bevel 140 is separated from the first face bevel 138 by a first intermediate bevel 142.

The first intermediate bevel 142 extends the entire length of the handle body 131 from the bottom of the top cap 132 to the top of the base cap 170 through both the top half portion 134 and the bottom half portion 136 of the handle body 131 and is contiguous with both the first face bevel 138 and the first edge bevel 140. The edge of the first intermediate bevel 142 adjoining the first face bevel 138 is oblique to the edge of the first intermediate bevel 142 adjoining the first edge bevel 140. The width of the base of the first intermediate bevel 142 disposed in the bottom half portion 136 of the handle 130 is wider than the top of the first intermediate bevel 142 disposed in the top half portion 134 of the handle body 131. Furthermore, the first intermediate bevel 142 is wider at every point within the bottom half portion 136 than at any point within the top half portion 134 of the handle body 131. The first intermediate bevel 142 is trapezoidal and chiral.

The second intermediate bevel 148 is disposed between and contiguous with the first face bevel 138 and the second edge bevel 141. The second intermediate bevel 148 is an enantiomorph of the first intermediate bevel 142. The second intermediate bevel 148 is delineated by edges extending around the periphery thereof. A first edge of the second intermediate bevel 148 adjoins the first face bevel 138 and an opposed edge of the second intermediate bevel 148 adjoins the second edge bevel 141. The edge of the second intermediate bevel 148 that adjoins the second edge bevel 141 is oblique to the edge of the second intermediate bevel 148 that adjoins the first face bevel 138. The second intermediate bevel 142 also is trapezoidal and chiral.

The second edge bevel 141 is disposed between and contiguous with the second intermediate bevel 148 and the third intermediate bevel 150. The second edge bevel 141 is disposed on the second edge side 115 of the frame 110. The second edge side 141 extends from the bottom of the top cap 132 through the top half portion 134 to the bottom half portion 136 of the handle body 131 and terminates at the top of the base cap 170. The second edge bevel 141 is a rectangular and planar.

Figure 3:
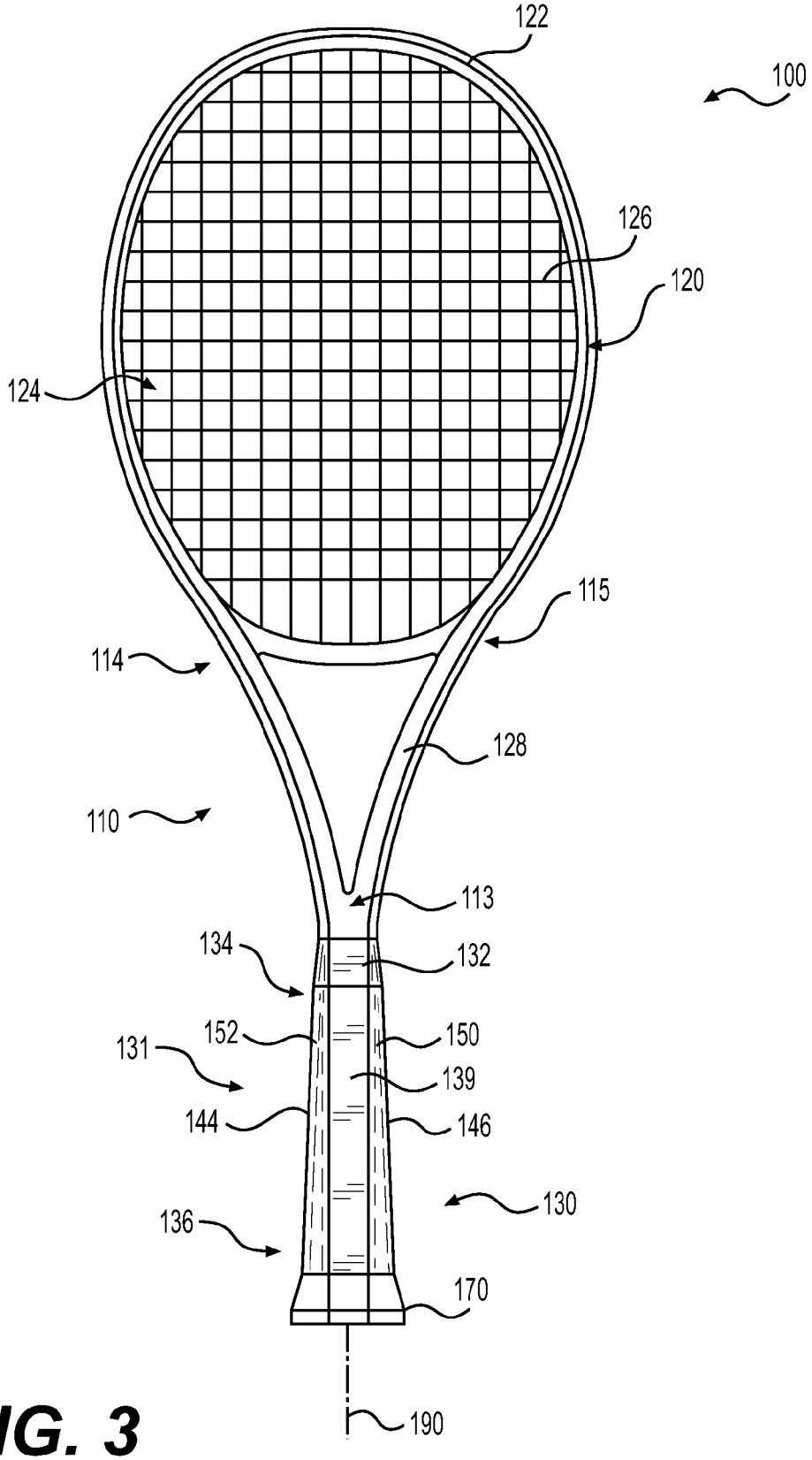
FIG. 3 is an elevation view of a second face side of the sports racket shown in FIG. 1.
Figure 4:
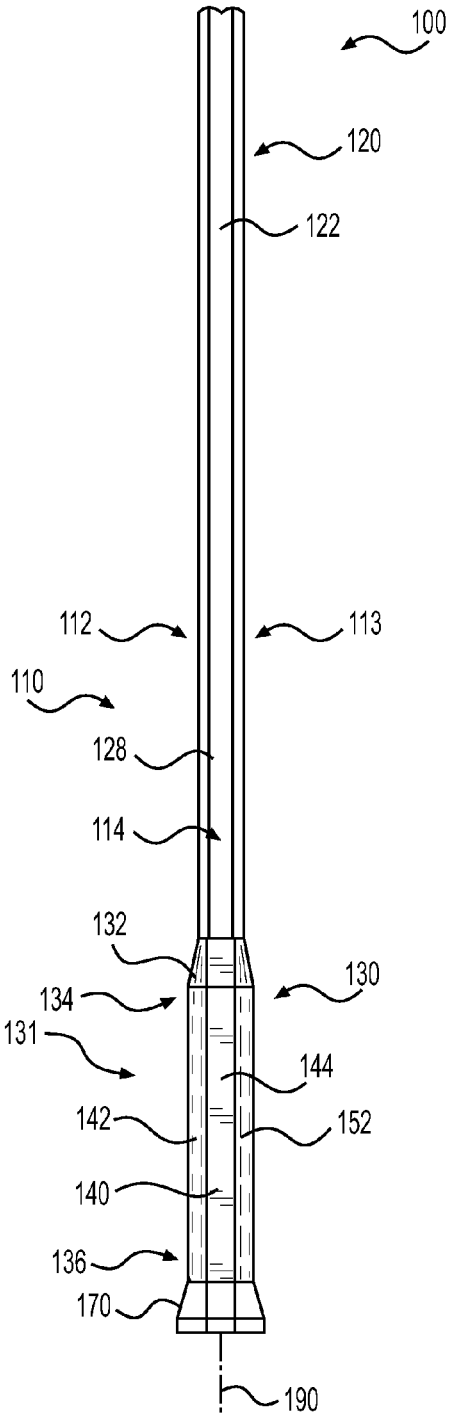
FIG. 4 is an elevation view of a first edge side of the sports racket shown in FIG. 1.
Figure 5:
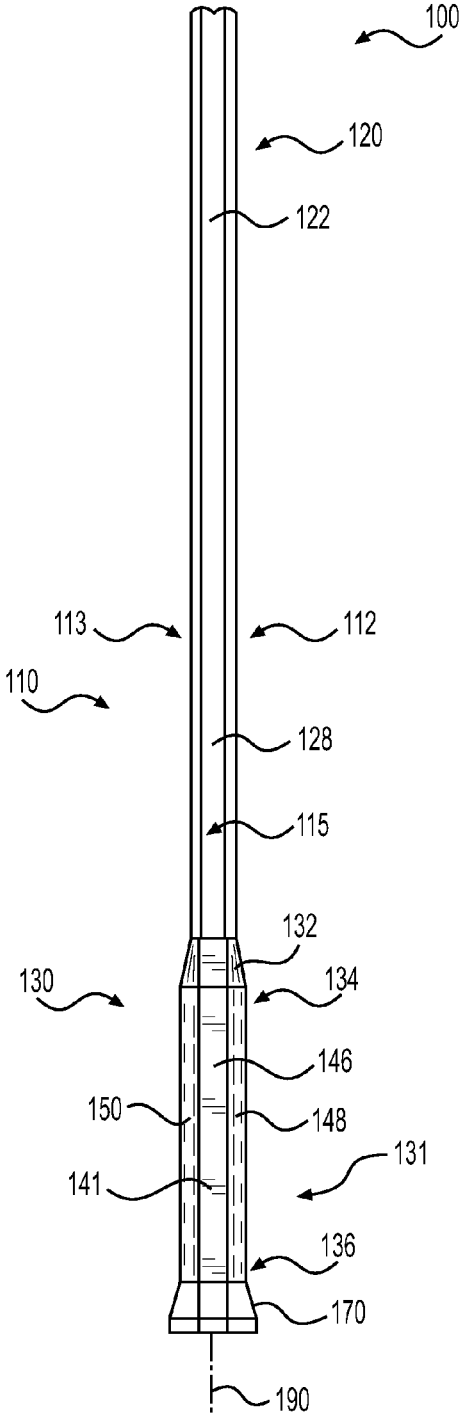
FIG. 5 is an elevation view of a second edge side of the sports racket shown in FIG. 1.
Figure 6:
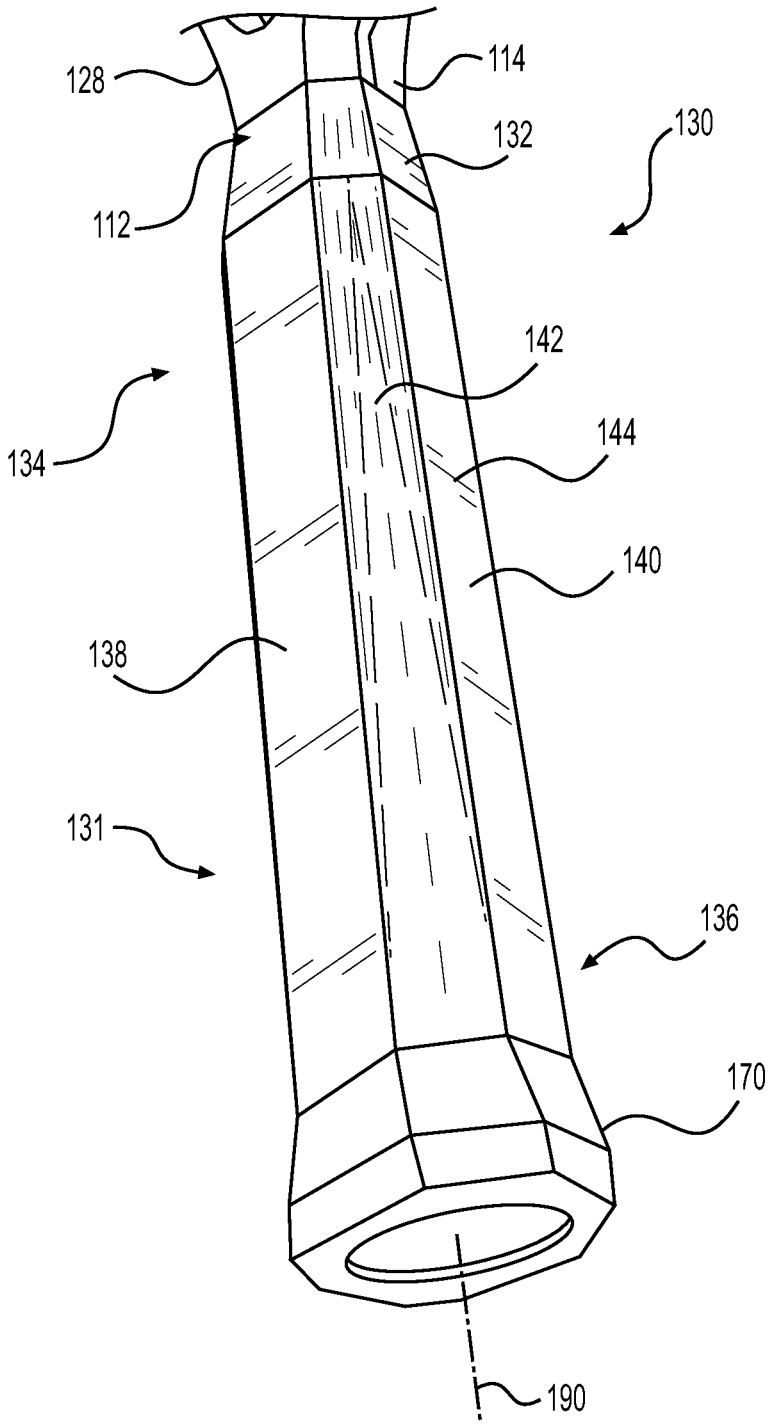
FIG. 6 is an enlarged perspective view of the handle and a portion of the throat of the sports racket shown in FIG. 1.
Figure 7:
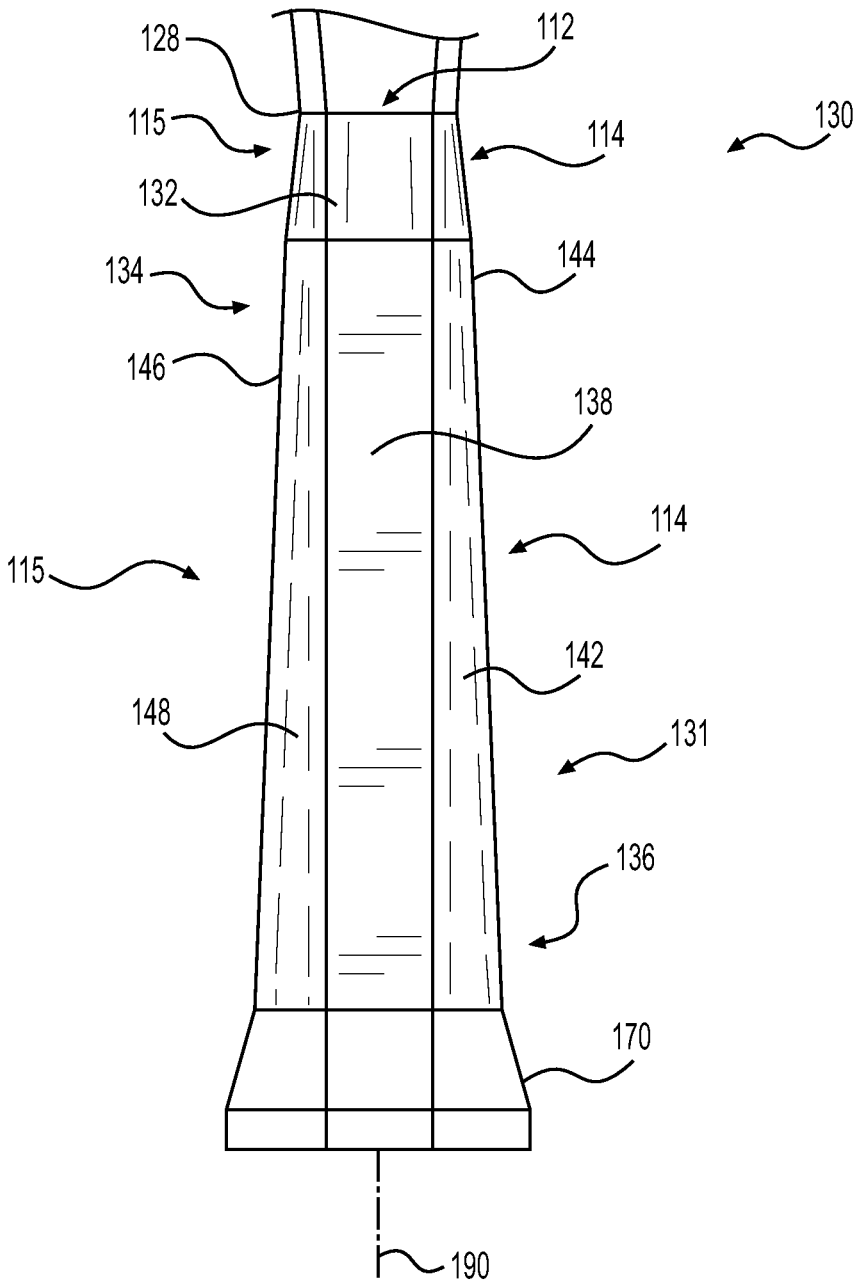
FIG. 7 is an enlarged elevation view of the first face side of the handle and a portion of the throat of the sports racket shown in FIG. 1.
Figure 8:
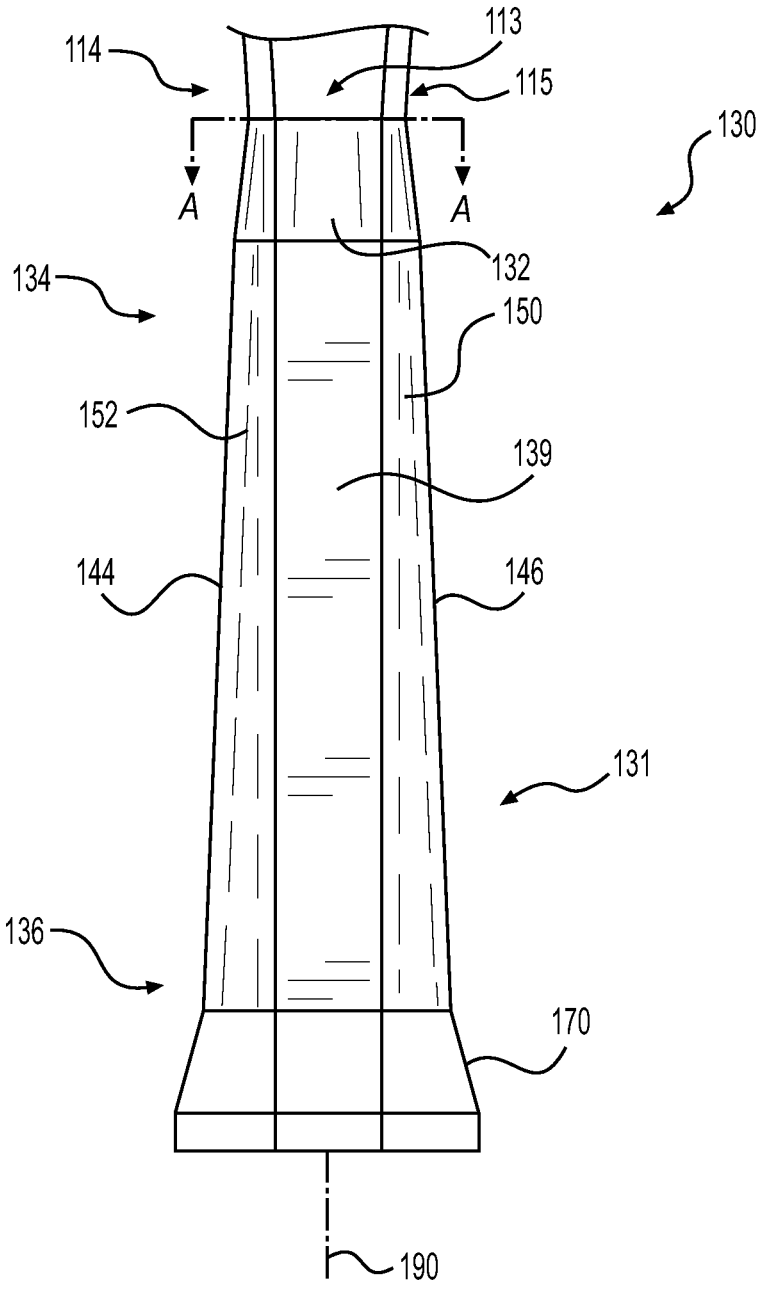
FIG. 8 is an enlarged elevation view of the second face side of the handle and a portion of the throat of the sports racket shown in FIG. 1.
Figure 9:
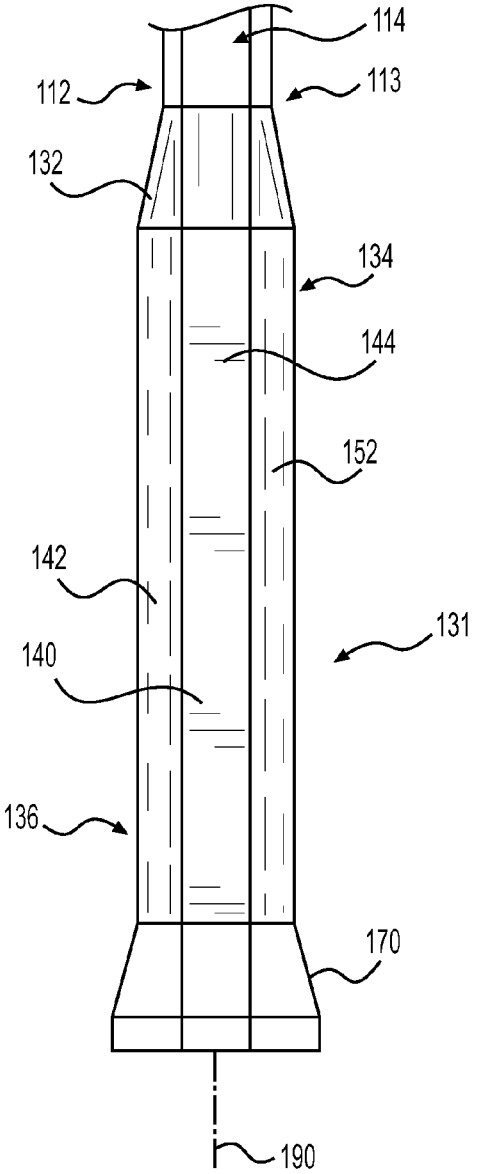
FIG. 9 is an enlarged elevation view of the first edge side of the handle and a portion of the throat of the sports racket shown in FIG. 1.
Figure 10:
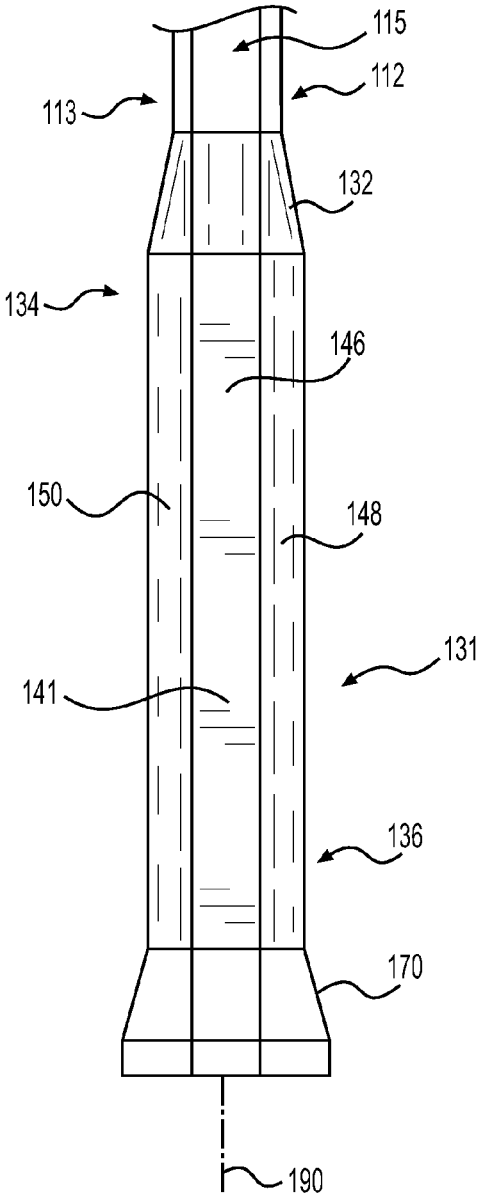
FIG. 10 is an enlarged elevation view of the second edge side of the handle and a portion of the throat of the sports racket shown in FIG. 1.
Figure 11:
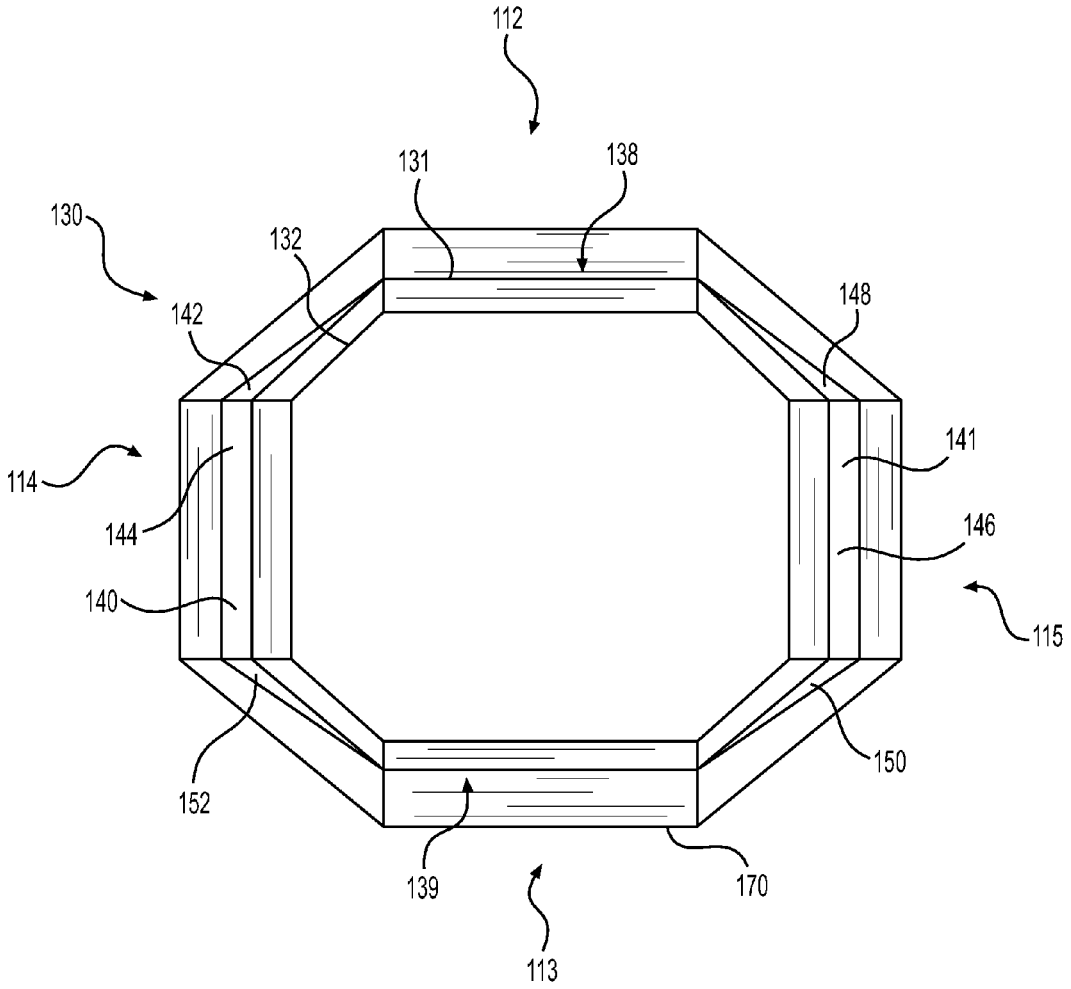
FIG. 11 is an enlarged cross-sectional view of the handle of the sports racket shown in FIG. 1 taken along line A-A of FIG. 8.
Figure 12:
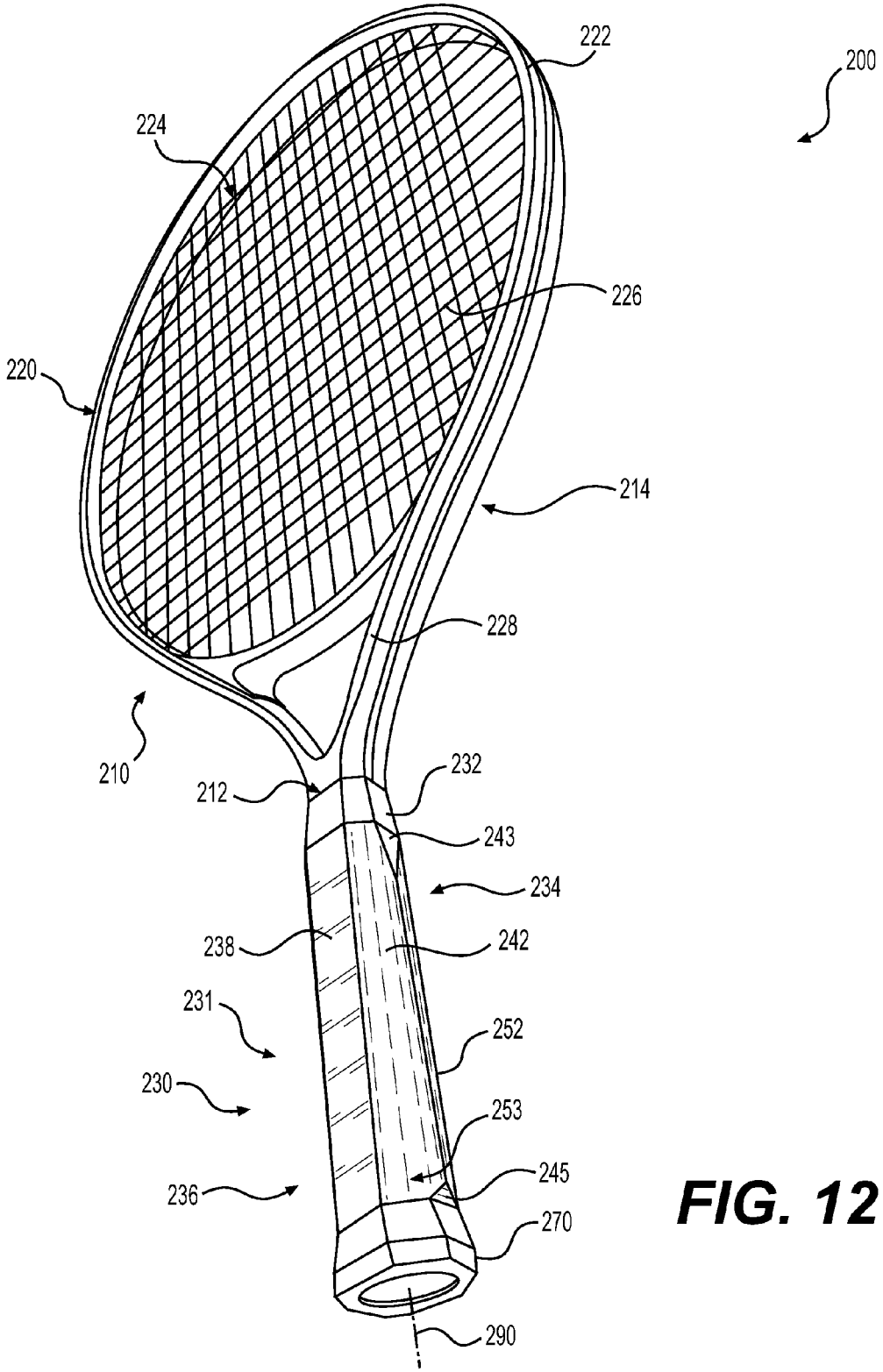
FIG. 12 is a perspective view of another sports racket encompassing aspects of the present disclosure.
Figure 13:
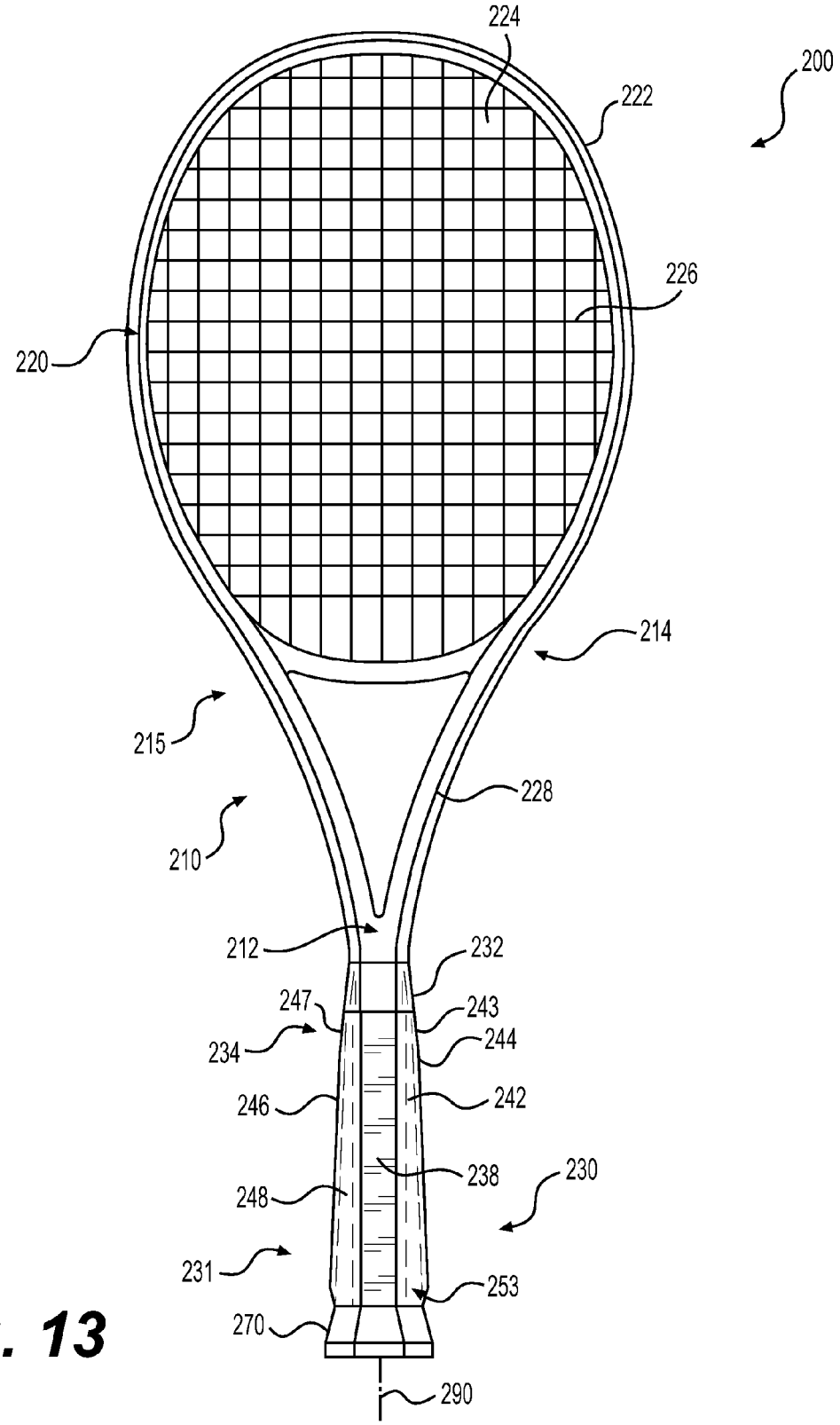
FIG. 13 is an elevation view of a first face side of the sports racket shown in FIG. 12.

As shown in FIG. 3, the handle body 131 includes a second face bevel 139 that is aligned on the second face side 113 of the frame 110. Like the first face bevel 138, the second face bevel 139 is rectangular and disposed between the bottom of the top cap 132 and the top of the base cap 170 and extends from the top half portion 134 through the bottom half portion 136 of the handle body 131. The first face bevel 138 and the second face bevel 139 are both planar and aligned parallel to each other. The sports rackets of the present disclosure also encompass non-planar face bevels that are aligned on opposing sides of the handle. The second face bevel 139 is delineated by edges extending around the perimeter thereof. The second face bevel 139 adjoins the top cap 132, the base cap 170, the third intermediate bevel 150, and the fourth intermediate bevel 152. The first edge of the second face bevel 139 that adjoins the third intermediate bevel 150 is parallel to the second edge of the second face bevel that adjoins the fourth intermediate bevel 152.

The third intermediate bevel 150 is disposed between and contiguous with the second face bevel 139 and the second edge bevel 141. The third intermediate bevel 150 is chiral and an enantiomorph of both the second intermediate bevel 148 and the fourth intermediate bevel 152 and congruent with the first intermediate bevel 142. The width of the top of the third intermediate bevel 150 disposed in the top half portion 134 of the handle body 131 is narrower than the width of the base of the third intermediate bevel 150 disposed in the bottom half portion 136 of the handle body 131. The edge of the third intermediate bevel 150 adjoining the second edge bevel 141 is oblique to the edge of the third intermediate bevel 150 adjoining the second face bevel 139. The third intermediate bevel 150 is trapezoidal.

The fourth intermediate bevel 152 is disposed between and contiguous with the second face bevel 139 and the first edge bevel 140. The fourth intermediate bevel 152 is extends from the bottom edge of the top cap 132 to the top edge of the base cap 170 and extends from the top half portion 134 to the bottom half portion 136 of the handle body 131. One edge of the fourth intermediate bevel 152 adjoins the second face bevel 139 and another edge of the fourth intermediate bevel 152 adjoins the first edge bevel. The edge of the fourth intermediate bevel 152 adjoining the first edge bevel 140 is oblique to the edge of the fourth intermediate bevel 152 adjoining the second face bevel 139. The width of the fourth intermediate bevel 152 is narrower in the top half portion 134 than the width of the portion of the fourth intermediate bevel 152 in the bottom half portion 136 of the handle body 131. The fourth intermediate bevel 152 is chiral and an enantiomorph of the third intermediate bevel 150 and the first intermediate bevel 142 and is congruent with the second intermediate bevel 148. The fourth intermediate bevel 152 is trapezoidal.

As shown in FIGS. 1-11, the first, second, third, and fourth intermediate bevels 142, 148, 150, and 152, respectively, are planar. In an alternative aspect, any one or more of the first, second, third, and fourth intermediate bevels 142, 148, 150, and 152, respectively, can comprise both a rounded portion or, alternatively, the combination of a curved portion and a planar portion. In one embodiment, the curved portion of one or more of the first, second, third, and fourth intermediate bevels 142, 148, 150, and 152, respectively, can be disposed in the top half portion 134 of the handle body 131. In an alternative embodiment, the planar portion of one or more of the first, second, third, and fourth intermediate bevels 142, 148, 150, and 152, respectively, can be disposed in the bottom half portion 136 of the handle body 131.

The handle body 131 includes a first shoulder 144 and a second shoulder 146. As shown in FIGS. 2, 3, 7, 8, and 11, both the first shoulder 144 and the second shoulder 146 extend from the top cap 132 to the bottom cap 170. The first shoulder 144 and the second shoulder 146 are disposed on opposing sides of the handle body 131 and are aligned on the first and second edge sides 114 and 115, respectively. Each of the first and the second shoulders 144 and 146 flare outward from the top half portion 134 to the bottom half portion 136 of the handle body 131. The alignment of the first shoulder 144 and the second shoulder 146 on the racket 100 allows a user to sense by touch the alignment of the racket 100 within the users hand since the width of the handle 130 is wider along the shoulders 144 and 146 than on the face sides of the handle. As shown in FIGS. 2,3, 7 and 8, the first shoulder 144 and the second shoulder 146 extend 100% of the length of the handle body 131.

The base cap 170 is connected to the bottom half portion 136 of the handle body 131 and can be flared wider than the bottom half portion 136 of the handle body 131, as shown in FIGS. 1-11. The base cap 170 is attached to the end of the handle body 131 and can be a conventional octagonal cap with flared sides and a base that is wider than the top thereof. Alternatively, the base cap can be of a different configuration. The sports rackets encompassed by the present disclosure also can include handles that do not include separate base caps, but rather have handle bodies that extend to and terminate at the end of the handle distal to the head of the racket.

As shown in FIGS. 1-11, the first face bevel 138 and the second face bevel 139 are flat or planar, though in alternative embodiments, either or both of the first face bevel 138 and the second face bevel 139 can include rounded contours, dimples, or non-planar contours.

As shown in FIGS. 1-10, the first face bevel 138 and the second face bevel 139 are aligned parallel to the axis 190 extending longitudinally through the handle 130. First shoulder 144 and second shoulder 146 are both oblique to the axis 190, as are the first, second, third and fourth intermediate bevels 142, 148, 150, and 152 and the first edge bevel 140 and the second edge bevel 141.

FIGS. 12-22 show another sports racket 200 and parts thereof that encompasses aspects of the present disclosure. The sports racket 200 includes a frame 210 that has a first face side 212, a second face 213, a first edge side 214, and a second edge side 215. The widest portions of the first and second face sides 212 and 213 are wider than the widest portions of the first and second edge sides 214 and 215. The first face side 212 is opposite to the second face side 213, as is the first edge side 214 opposite to the second edge side 215. The frame 210 also includes a head 220, a throat 228 and a handle 230. The head 220 is aligned at the top of the frame 210 and is connected to the handle 230 by the throat 228. The head 220 includes a hoop 222 that defines an aperture 224 that is open to both the first face side 212 and the second face side 213 of the frame 210. Across the aperture 224 are strung one or more strings 226 that connect to opposing points along the hoop 222.

The handle 230 includes a top cap 232 disposed at the top of the handle 230 proximal to the throat 228 and the head 220, a handle body 231 disposed below the top cap 232 distal to the throat 228 and the head 220, and a base cap 270 attached to the bottom half portion 236 of the handle body 231.

The handle body 231 of handle 130 includes a top half portion 234 that is proximal to the head 220 and a bottom half portion 236 that is distal to the head 220. The top half portion 234 is disposed adjacent the top cap 232 and the bottom half portion 236 is attached to the base cap 270. Both the top half portion 234 and the bottom half portion 236 extend one half of the distance between the bottom of the top cap 232 and the top of the base cap 270, or, alternatively, one half the distance of the total length of the handle body 231. The handle body 231 comprises a plurality of bevels that form the outer surface thereof. The handle body 231 includes six bevels that extend the entire length of the handle body 2231 from the top cap 232 to the base cap 270. The first face bevel 238 is formed on the handle body 231 and is aligned on the first face side 212 of the frame 210. The first face bevel 238 extends from the bottom of the top cap 232 to the top of the base cap 270. The first face bevel 238 is delineated by edges extending around the perimeter thereof, and is a rectangle with a width extending across a portion of the first face side 212 of the frame 210 and a length extending between the top cap 232 and the base cap 270.

The first intermediate bevel 242 extends the entire length of the handle body 231 from the bottom of the top cap 232 to the top of the base cap 270 through both the top half portion 234 and the bottom half portion 236 of the handle body 231. The first intermediate bevel 242 adjoins and is contiguous with both the first face bevel 238 and the fourth intermediate bevel 252. The edge of the first intermediate bevel 242 adjoining the first face bevel 238 is oblique to the edge of the first intermediate bevel 242 adjoining the fourth intermediate bevel 252. The edge adjoining the first and the fourth intermediate bevels 242 and 252 is aligned on the first edge side 214 of the frame 210. The width of the widest portion of the first intermediate bevel 242 disposed in the bottom half portion 236 of the handle body 231 is wider than width of the widest portion of the first intermediate bevel 242 disposed in the top half portion 234 of the handle body 231. The first intermediate bevel 242 is hexagonal and chiral.

The second intermediate bevel 248 is disposed between and contiguous with the first face bevel 238 and the third intermediate bevel 250. The second intermediate bevel 248 is chiral and an enantiomorph of the first intermediate bevel 242 and the third intermediate bevel 250. The second intermediate bevel 248 is delineated by edges extending around the periphery thereof, and extends the entire length of the handle body 231 from the bottom half portion of the top cap 232 through the top half portion 234 to the bottom half portion 236 of the handle body 231 and terminates at the top of the base cap 270. The first edge of the second intermediate bevel 248 adjoins the first face bevel 238 and an opposed edge of the second intermediate bevel 248 adjoins the third intermediate bevel 250. The edge of the second intermediate bevel 248 adjoining the third intermediate bevel 250 is aligned on the second edge side 215 of the frame 210 and is oblique to the edge of the second intermediate bevel 248 adjoining the first face bevel 238. The second intermediate bevel 248 also is hexagonal.

The third intermediate bevel 250 is disposed between and contiguous with the second intermediate bevel 248 and the second face bevel 239. The third intermediate bevel 250 is chiral and an enantiomorph of the second intermediate bevel 248 and the fourth intermediate bevel 252 and is congruent with the first intermediate bevel 242. The third intermediate bevel 250 extends the entire length of the handle body 231 from the bottom half portion of the top cap 232 through the top half portion 234 to the bottom half portion 236 and terminates at the top of the base cap 270. The third intermediate bevel also is hexagonal.

Figure 14:
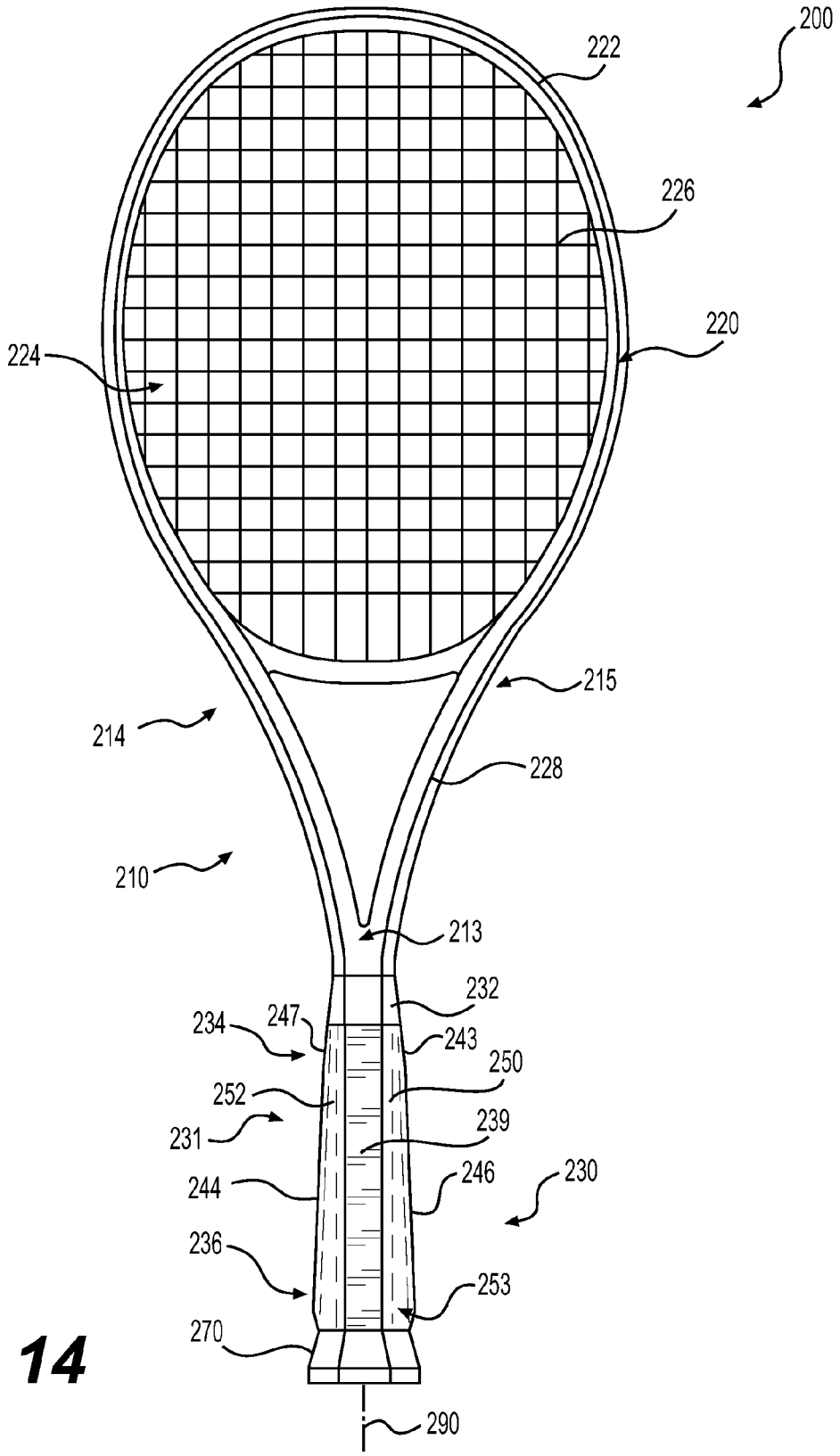
FIG. 14 is an elevation view of a second face side of the sports racket shown in FIG. 12.
Figure 15:
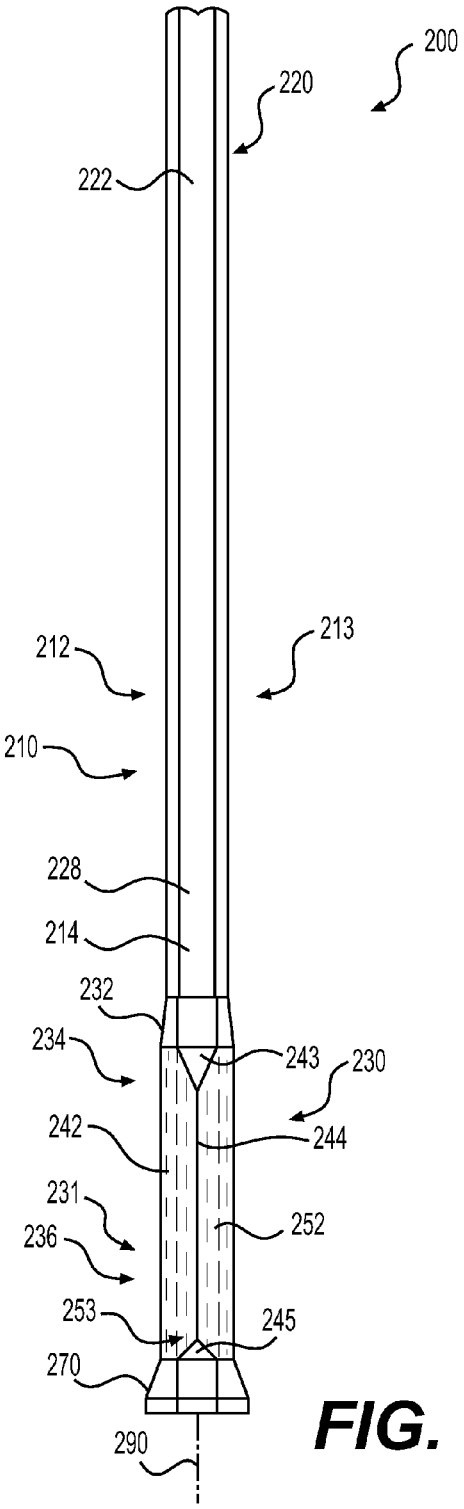
FIG. 15 is an elevation view of a first edge side of the sports racket shown in FIG. 12.
Figure 16:
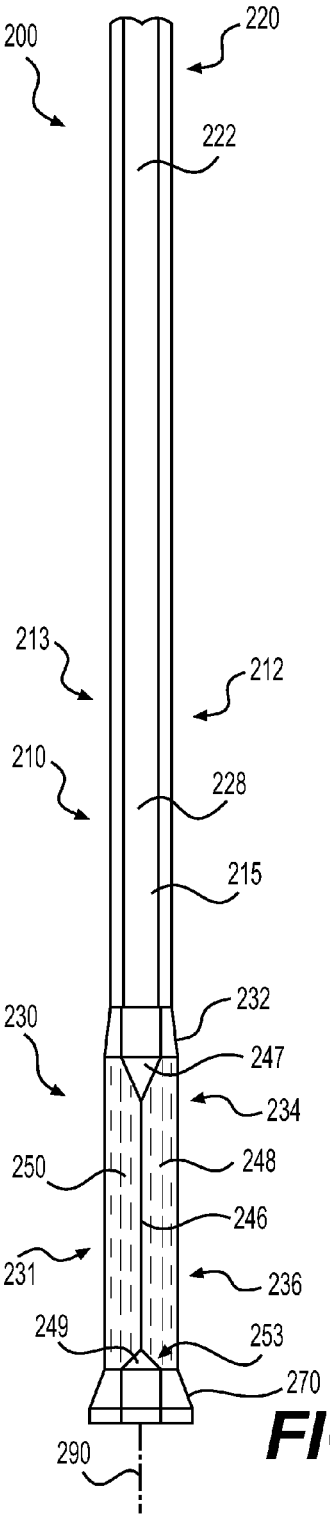
FIG. 16 is an elevation view of a second edge side of the sports racket shown in FIG. 12.
Figure 17:
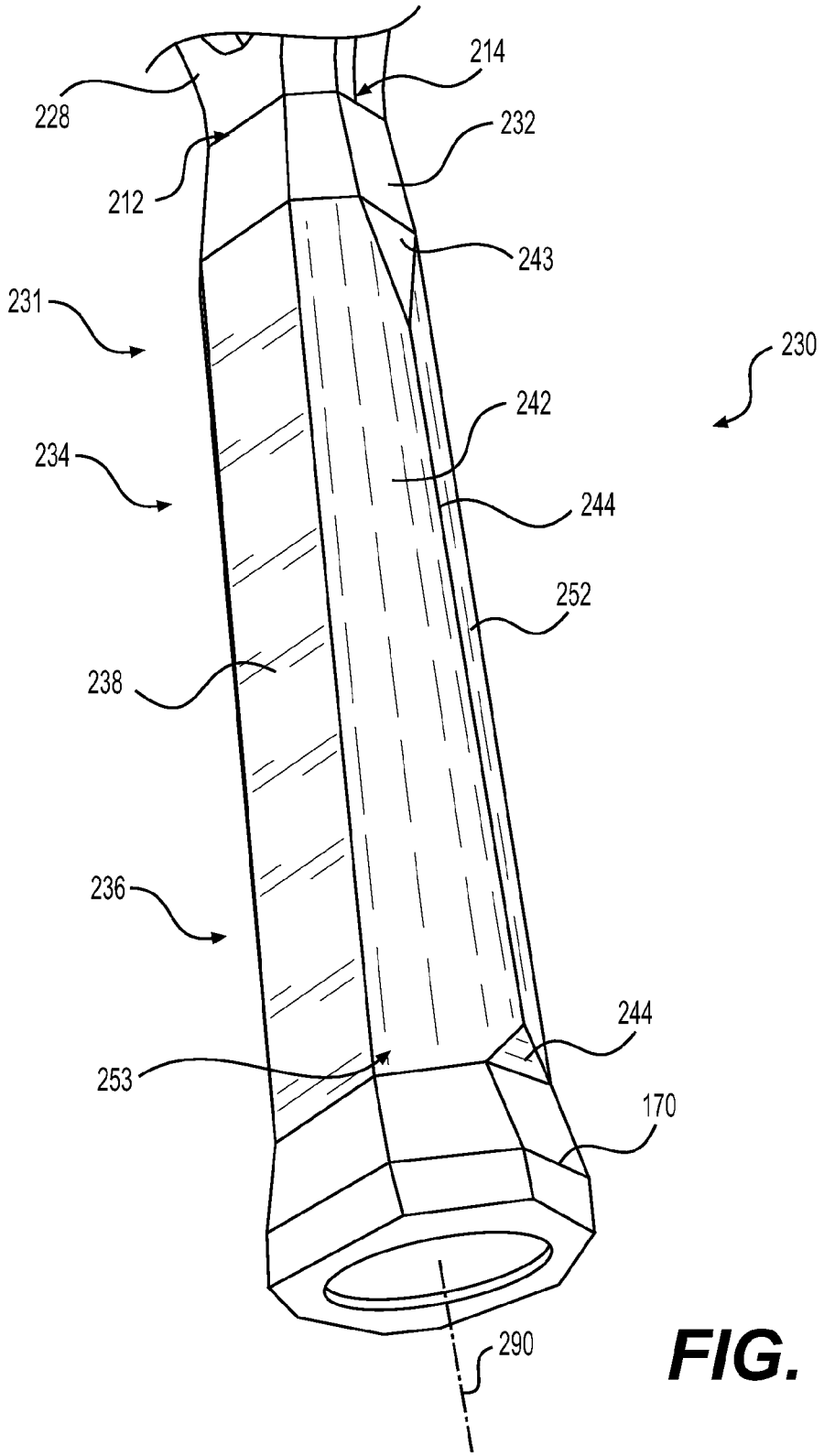
FIG. 17 is an enlarged perspective view of the handle and a portion of the throat of the sports racket shown in FIG. 12.
Figure 18:
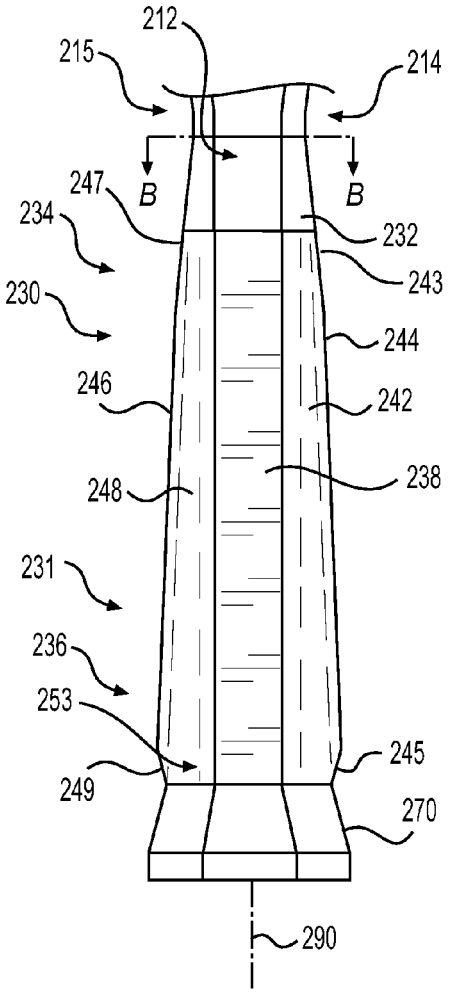
FIG. 18 is an enlarged elevation view of the first face side of the handle and a portion of the throat of the sports racket shown in FIG. 12.
Figure 19:
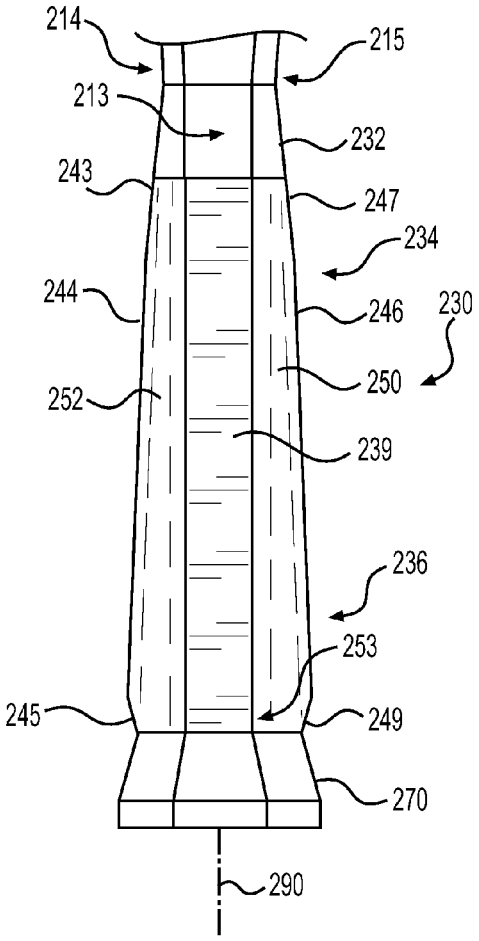
FIG. 19 is an enlarged elevation view of the second face side of the handle and a portion of the throat of the sports racket shown in FIG. 12.
Figure 20:
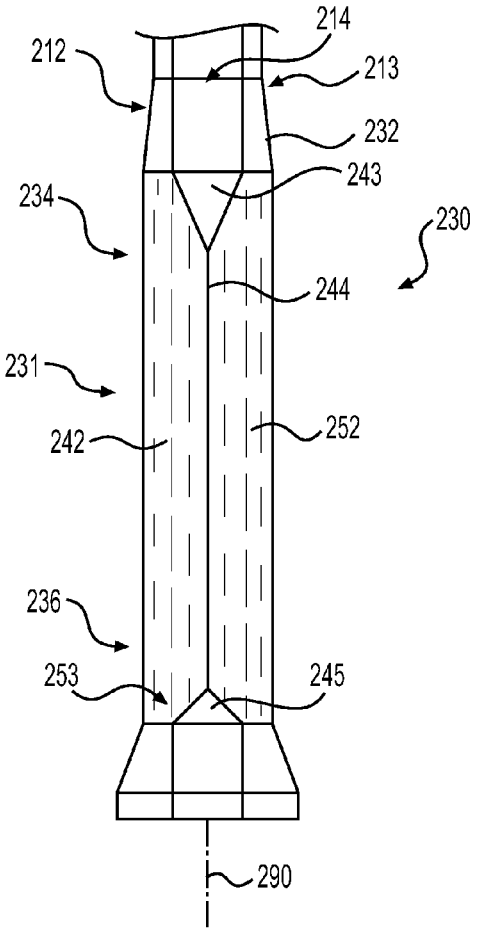
FIG. 20 is an enlarged elevation view of the first edge side of the handle and a portion of the throat of the sports racket shown in FIG. 12.
Figure 21:
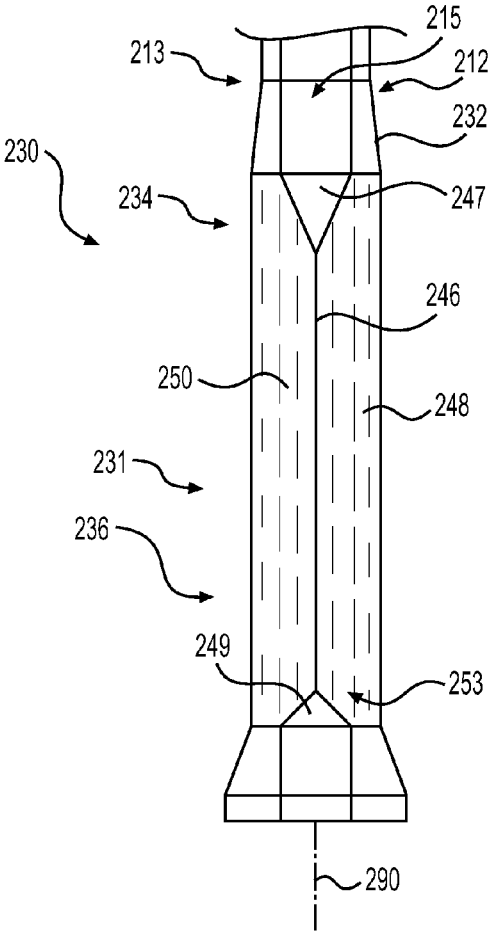
FIG. 21 is an enlarged elevation view of the second edge side of the handle and a portion of the throat of the sports racket shown in FIG. 12.
Figure 22:
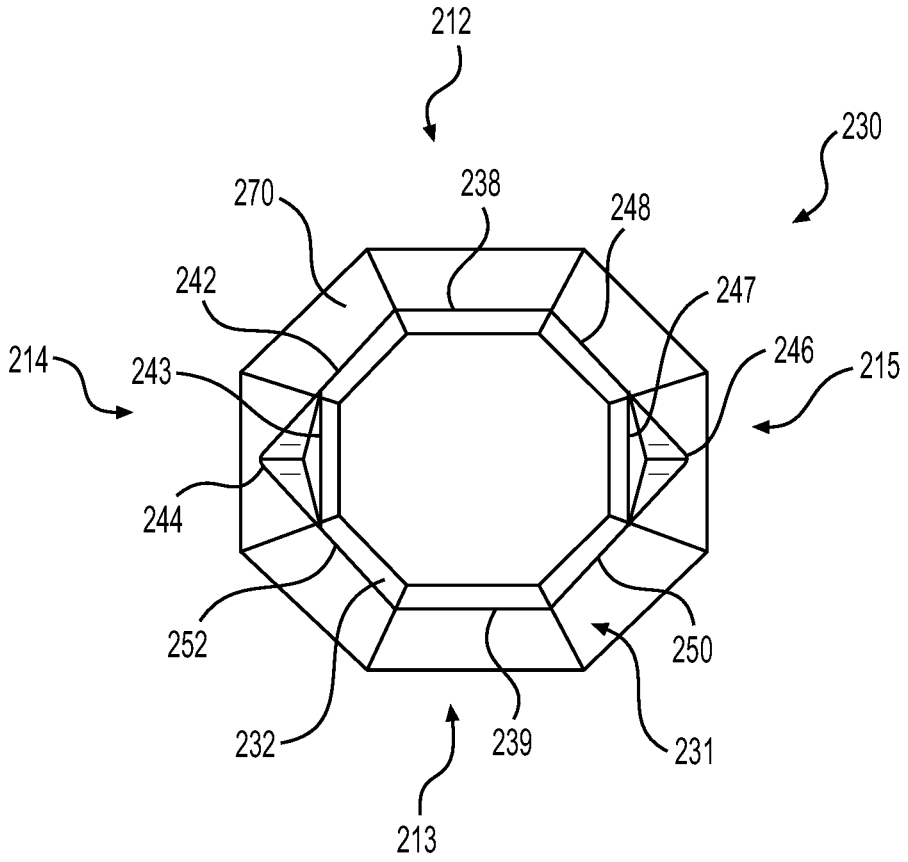
FIG. 22 is an enlarged cross-sectional view of the handle of the sports racket shown in FIG. 12 taken along line B-B of FIG. 18.
Figure 23:
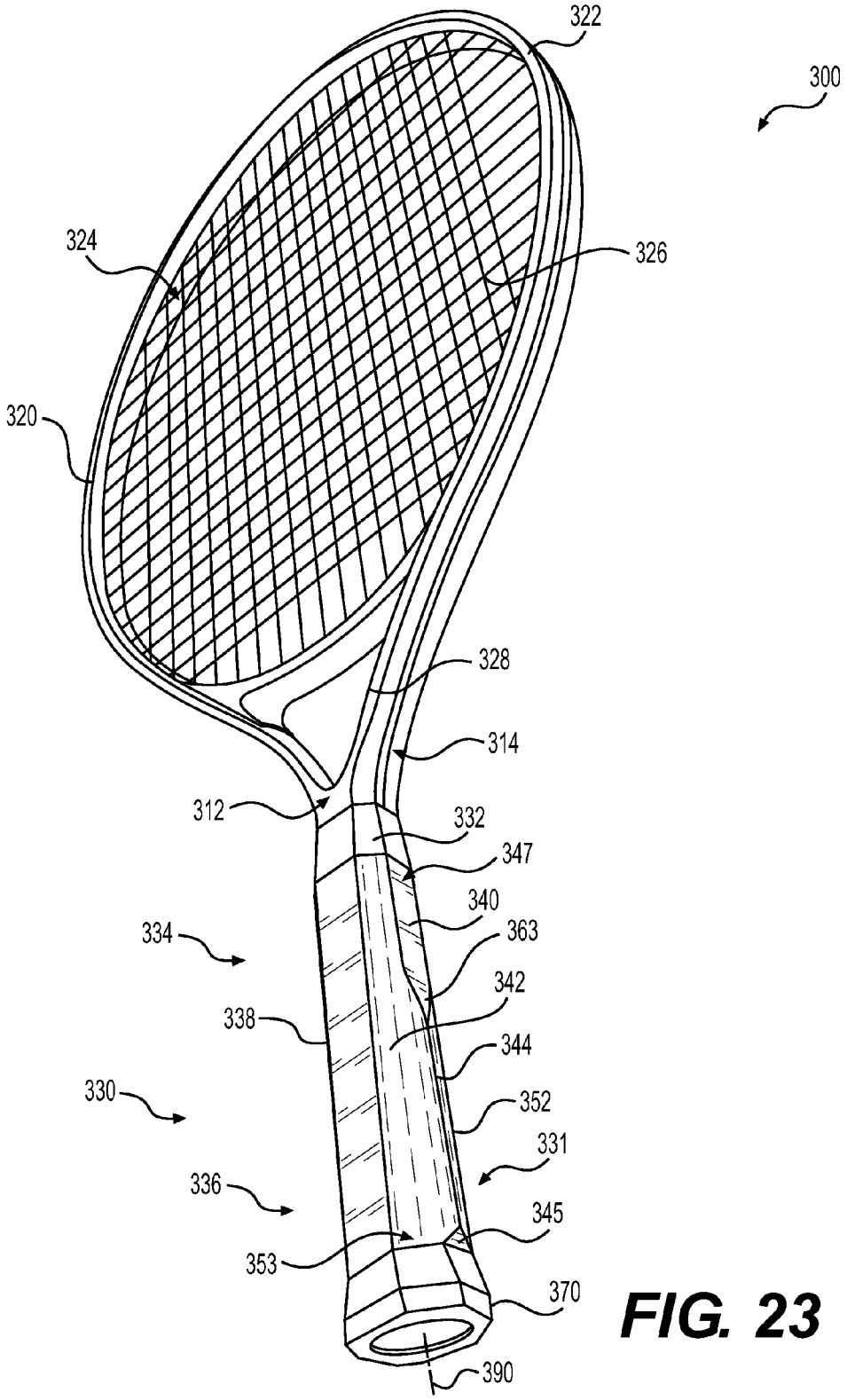
FIG. 23 is a perspective view of yet another sports racket encompassing aspects of the present disclosure.
Figure 24:
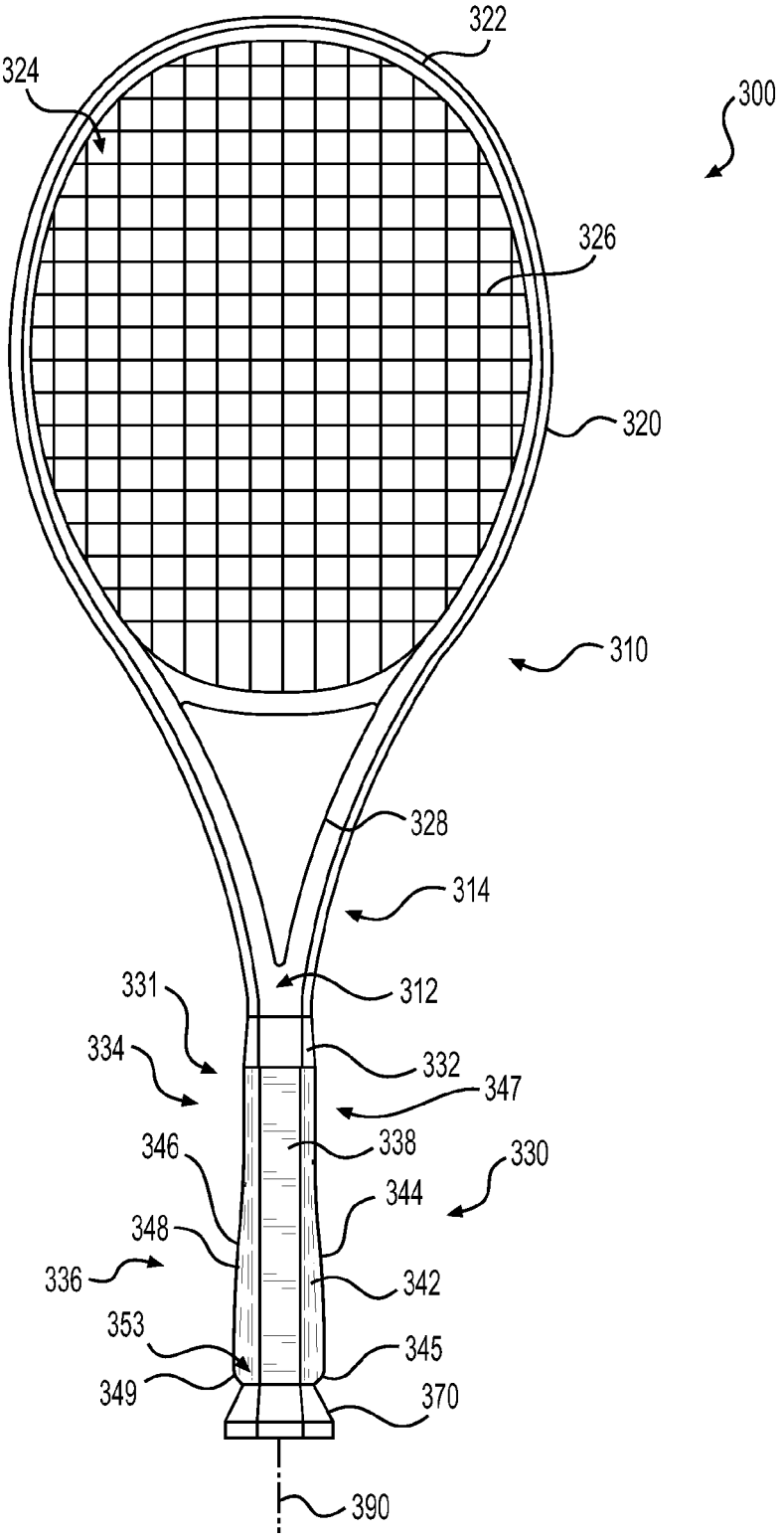
FIG. 24 is an elevation view of a first face side of the sports racket shown in FIG. 23.
Figure 25:
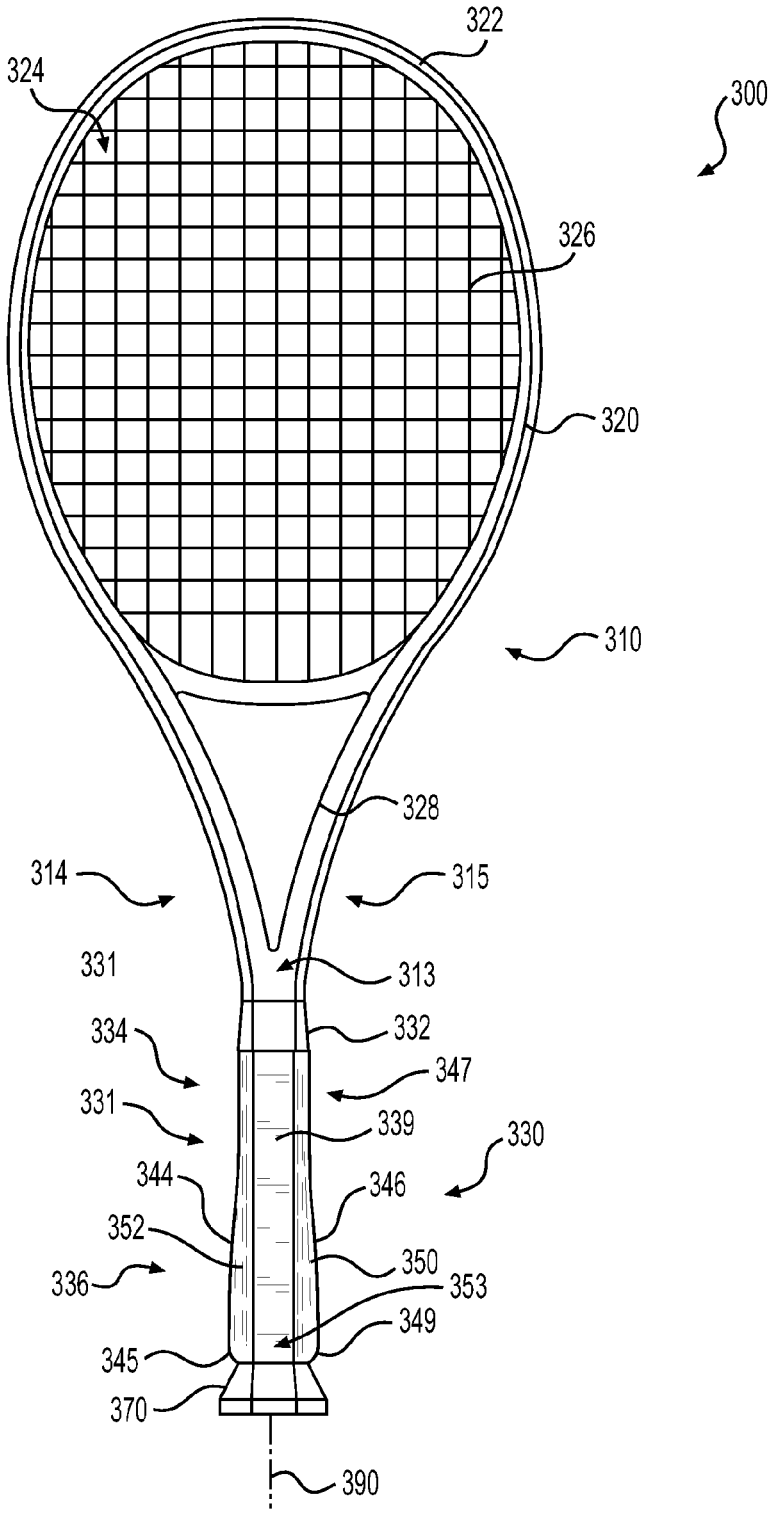
FIG. 25 is an elevation view of a second face side of the sports racket shown in FIG. 23.
Figure 26:
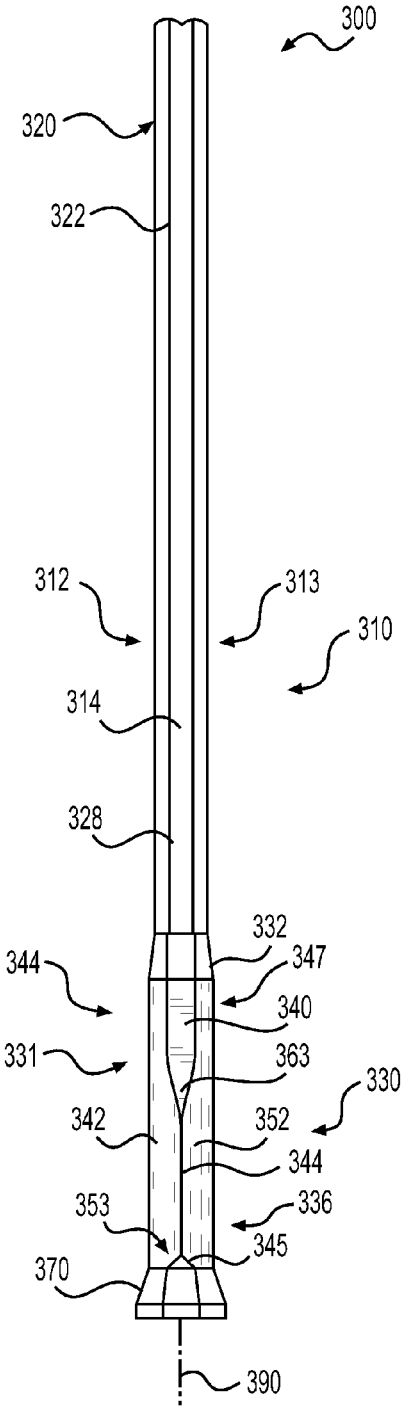
FIG. 26 is an elevation view of a first edge side of the sports racket shown in FIG. 23.
Figure 27:
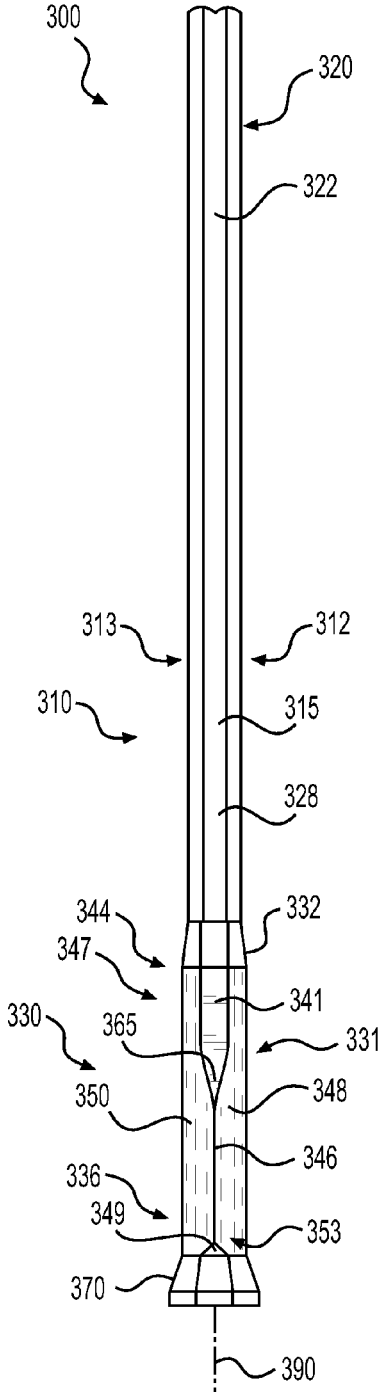
FIG. 27 is an elevation view of a second edge side of the sports racket shown in FIG. 23.

As shown in FIG. 14, the handle body 231 includes a second face bevel 239 that is aligned on the second face side 213 of the frame 210 and is disposed between and continuous with the third intermediate bevel 250 and the fourth intermediate bevel 252. Like the first face bevel 238, the second face bevel 239 is rectangular and disposed between the bottom of the top cap 232 and the top of the base cap 270 and extends the entire length of the handle body 231 from the top half portion 234 through the bottom half portion 236 of the handle body 231. The second face bevel 239 is congruent with the first face bevel 238. As shown in FIGS. 18-22, the first face bevel 238 and the second face bevel 239 are both planar and aligned parallel to each other and to the axis 290 extending longitudinally through the handle 230.

The fourth intermediate bevel 252 is disposed between and contiguous with the second face bevel 239 and the first intermediate bevel 242. The fourth intermediate bevel 252 is chiral and an enantiomorph of the first and third intermediate bevel 242 and 250 and congruent with the second intermediate bevel 248. The width of the widest portion of the fourth intermediate bevel 252 disposed in the top half portion 234 of the handle body 231 is narrower than the width of the widest portion of the fourth intermediate bevel 252 disposed in the bottom half portion 236 of the handle body 231. The edge of the fourth intermediate bevel 252 adjoining the second face bevel 239 is oblique to the edge of the fourth intermediate bevel 252 adjoining the first intermediate bevel 242. The fourth intermediate bevel 252 is hexagonal.

The handle body 231 also comprises a first top edge bevel 243 disposed in the top half portion 234 along the first edge side 214 of the frame 210 between a portion of the first intermediate bevel 242 and a portion of the fourth intermediate bevel 252 and below the top cap 232. The first top edge bevel is planar and triangular. On the second edge side 215 of the frame 210 is aligned a second top edge bevel 247, which is disposed in the top half portion 234 of the handle body 231 between a portion of the second intermediate bevel 248, the third intermediate bevel 250 and the top cap 232. The second edge bevel 247 also is triangular and planar and is aligned oblique to the first edge bevel 243.

The handle body 231 also comprises a first bottom edge bevel 245 disposed in the bottom half portion 236 along the first edge side 214 of the frame 210 between a portion of the first intermediate bevel 242 and a portion of the fourth intermediate bevel 252 and above the base cap 270. The first bottom edge bevel 245 is triangular and planar. On the second edge side 215 of the frame 210 is aligned a second bottom edge bevel 249, which is disposed in the bottom half portion 236 of the handle body 231 between a portion of the second intermediate bevel 248, the third intermediate bevel 250 and the base cap 270. The first bottom edge bevel 245 is aligned oblique to the second bottom edge bevel 249. The second bottom edge bevel 249 is also triangular and planar. The first and the second bottom edge bevels 245 and 249 form a waist 253 on the handle body 231 disposed in the bottom half portion 236 adjacent the base cap 270. The waist 253 has a width that is narrower than the widest portion of the bottom half portion 236 of the handle body 231. The waist 253 and the flared sides of the base cap 270 form retention slots on the first and second edge sides 214 and 215 in which a racket user can align one or more fingers to provide leverage and grip variations as the racket 200 is used.

The racket body 231 includes a pair of shoulders disposed thereon. The first shoulder 244 is disposed on the first edge side 214 of the handle 230 and the second shoulder 246 is disposed on the second edge side 215 of the handle 230. The first and second shoulders 244 and 246 extend downward from the head 220 and flare outward. The first shoulder 244 is formed by the first and the fourth intermediate bevels 242 and 252, whereas the second shoulder 246 is formed by the second and third intermediate bevels 248 and 250. The flared first and second shoulders 244 and 246 provide a racket user a broader surface to grip in the plane extending across the face sides of the racket 200 and surface indicators for the orientation of the racket 200 within the user's hand. The first shoulder 244 and the second shoulder 246 both extend more than 50% of the length of the handle body 231.

As shown in FIGS. 12-21, the first face bevel 238 and the second face bevel 239 are aligned parallel to the axis 290 extending longitudinally through the handle 230. First shoulder 244 and second shoulder 246 are both oblique to the axis 290, as are at least a portion of each of the first, second, third and fourth intermediate bevels 242, 248, 250, and 252.

FIGS. 23-33 show yet another sports racket 300 and parts thereof that encompass aspects of the present disclosure. The sports racket 300 includes a frame 310 that has a first face side 312, a second face 313, a first edge side 314, and a second edge side 315. The widest portions of the first and second face sides 312 and 313 are wider than the widest portions of the first and second edge sides 314 and 315. The first face side 312 is opposite to the second face side 313, as is the first edge side 314 opposite to the second edge side 315. The frame 310 also includes a head 320, a throat 328 and a handle 330. The head 320 is aligned at the top of the frame 310 and is connected to the handle 330 by the throat 328. The head 320 includes a hoop 322 that defines an aperture 324 that is open to both the first face side 312 and the second face side 313 of the frame 310. Across the aperture 324 are strung one or more strings 326 that connect to opposing points along the hoop 322.

The handle 330 includes a top cap 332 disposed at the top of the handle 330 proximal to the throat 328 and the head 320, a handle body 331 disposed below the top cap 332 distal to the throat 328 and the head 320, and a base cap 370 attached to the bottom half portion 336 of the handle body 331.

The handle body 331 of handle 330 includes a top half portion 334 that is proximal to the head 320 and a bottom half portion 336 that is distal to the head 320. The top half portion 334 is disposed adjacent the top cap 332 and the bottom half portion 336 is attached to the base cap 370. Both the top half portion 334 and the bottom half portion 336 extend one half of the distance between the bottom of the top cap 332 and the top of the base cap 370. The handle body 331 comprises a plurality of bevels that form the outer surface thereof. The handle body 331 includes six bevels that extend the entire length of the handle body 331 from the top cap 332 to the base cap 370 and two bevels that extend less than the entire length of the handle body 331 from the top cap 332 to intermediate points along the length of the handle body 331. The first face bevel 338 is formed on the handle body 331 and is aligned on the first face side 312 of the frame 310. The first face bevel 338 extends the entire length of the handle body 331 from the bottom of the top cap 332 to the top of the base cap 370. The first face bevel 338 is delineated by edges extending around the perimeter thereof, and is rectangular with a width extending across a portion of the first face side 312 of the frame 310 and a length extending between the top cap 332 and the base cap 370.

The first intermediate bevel 342 extends the entire length of the handle body 331 from the bottom of the top cap 332 to the top of the base cap 370 through both the top half portion 334 and the bottom half portion 336 of the handle body 331. The first intermediate bevel 342 adjoins and is contiguous with the first face bevel 338. A portion of the first intermediate bevel 342 also adjoins and is contiguous the fourth intermediate bevel 352. Another portion of the first intermediate bevel 342 adjoins and is contiguous with the first side bevel 340. The edge of the first intermediate bevel 342 adjoining the first face bevel 338 is oblique to the edge of the first intermediate bevel 342 adjoining the fourth intermediate bevel 352. The edge of the first intermediate bevel 342 adjoining the first face bevel 338 is parallel to a first portion of the edge of the first intermediate bevel 342 adjoining the first side bevel 340 and is oblique to a second portion of the edge of the first intermediate bevel 342 adjoining the first side bevel 340. The edge of the first intermediate bevel 342 that adjoins the fourth intermediate bevel 352 is aligned on the first edge side 314 of the frame 310. The width of the widest portion of the first intermediate bevel 342 disposed in the bottom half portion 336 of the handle body 331 is wider than the width of the widest portion of the first intermediate bevel 342 disposed in the top half portion 334 of the handle body 331. The first intermediate bevel 342 is six-sided, chiral, but non-polygonal.

Figure 28:
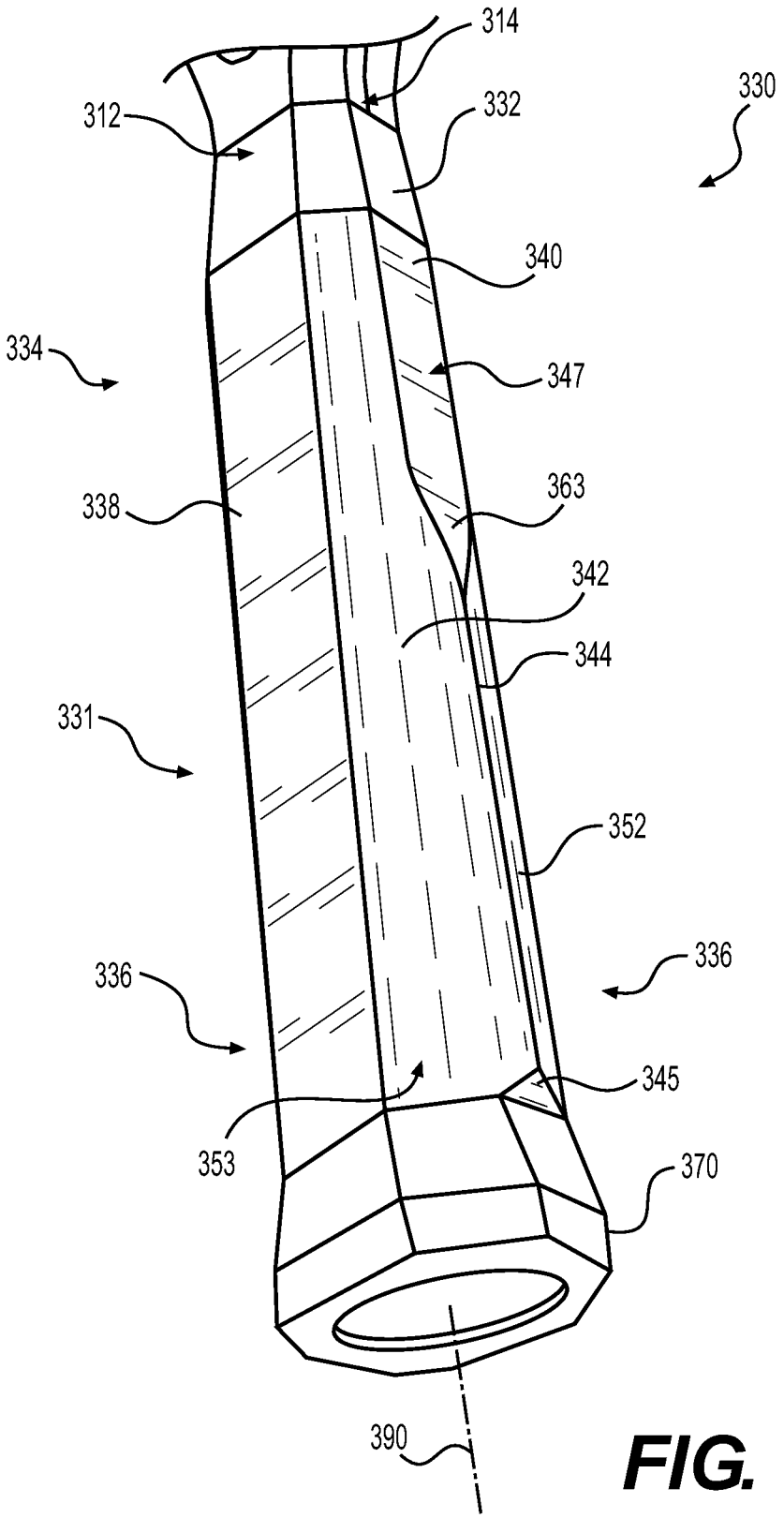
FIG. 28 is an enlarged perspective view of the handle and a portion of the throat of the sports racket shown in FIG. 23.
Figure 29:
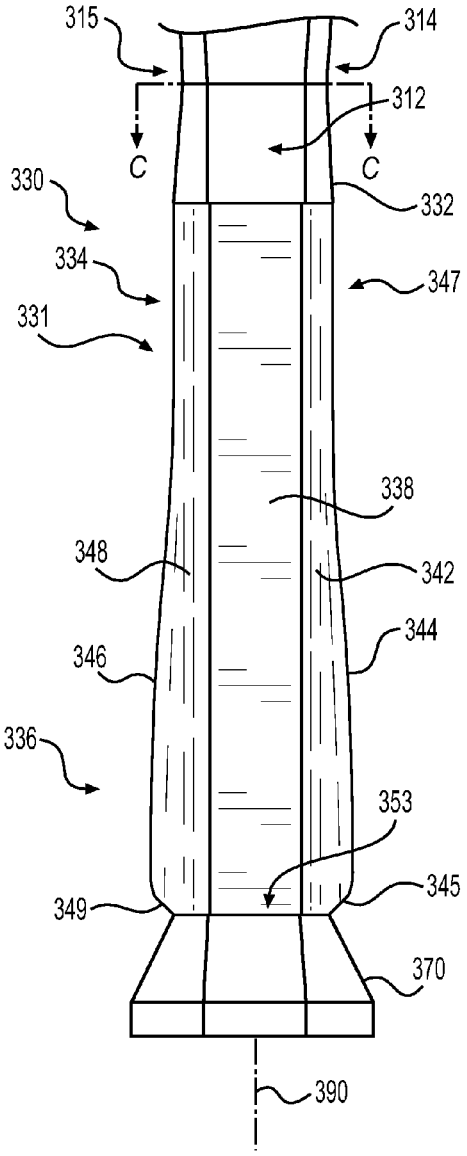
FIG. 29 is an enlarged elevation view of the first face side of the handle and a portion of the throat of the sports racket shown in FIG. 23.

The first edge bevel 340 is disposed between the first intermediate bevel 342, the fourth intermediate bevel 352 and the top cap 332. The first edge bevel 340 is disposed on the first edge side 314 of the frame 310 and includes a first edge and a second edge, portions of each are parallel to each other and other portions of which taper together and meet to form an angle. The first tapered portion 363 forms the lower termination point of the first edge bevel 340. The first edge bevel 340 extends from the bottom of the top cap 332 to an intermediate point along the length of the handle body 331. As shown in FIG. 28, the first edge bevel 340 is disposed within the top half portion 334 of the handle body 331.

The second intermediate bevel 348 is disposed between and contiguous with the first face bevel 338 and a portion of the third intermediate bevel 350. The second intermediate bevel 348 is chiral and an enantiomorph of the first intermediate bevel 342 and the third intermediate bevel 350. The second intermediate bevel 348 is delineated by edges extending around the periphery thereof, and extends the entire length of the handle body 331 from the bottom of the top cap 332 through the top half portion 334 to the bottom half portion 336 of the handle body 331 and terminates at the top of the base cap 370. A first edge of the second intermediate bevel 348 adjoins the first face bevel 338 and a second edge of the second intermediate bevel 348 adjoins a portion of the third intermediate bevel 350. A third edge of the second intermediate bevel 348 adjoins the second edge bevel 341. The second edge of the second intermediate bevel 348 adjoining the third intermediate bevel 350 is aligned on the second edge side 315 of the frame 310 and is oblique to the first edge of the second intermediate bevel 348 adjoining the first face bevel 338. A first portion of the third edge of the second intermediate bevel 348 adjoining the second edge bevel is parallel to the first edge of the second intermediate bevel 348 adjoining the first face bevel 338, whereas a second portion of the third edge of the second intermediate bevel 348 adjoining the second edge bevel 341 is oblique to the first edge of the second intermediate bevel 348 adjoining the first face bevel 338. The second intermediate bevel 342 also is six sided but non-polygonal.

Figure 31:
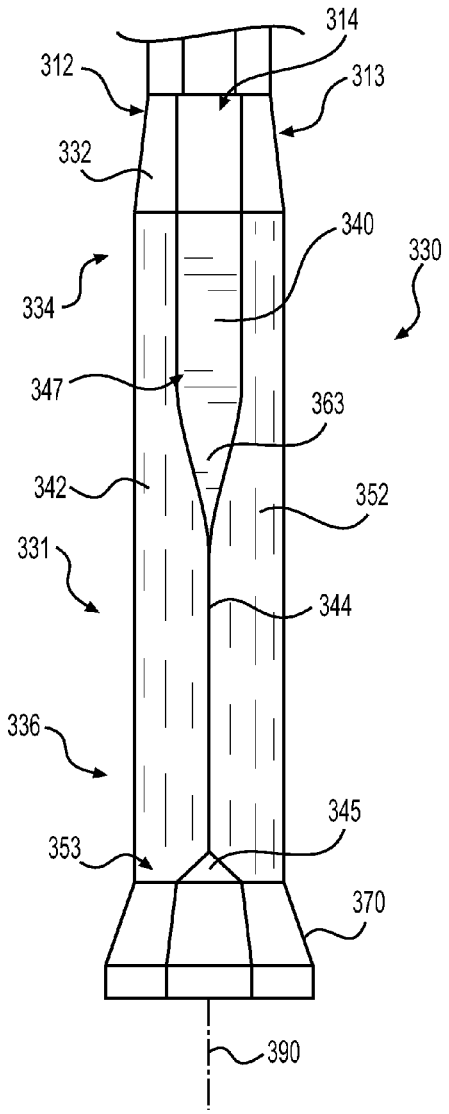
FIG. 31 is an enlarged elevation view of the first edge side of the handle and a portion of the throat of the sports racket shown in FIG. 23.

The second edge bevel 341 is disposed between the second intermediate bevel 348, the third intermediate bevel 350 and the top cap 332. The second edge bevel 341 is disposed on the second edge side 315 of the frame 310 and includes a first edge and a second edge portions of each of which are parallel to each other and which taper together and meet to form an angle. The second edge bevel 341 extends from the bottom of the top cap 332 to an intermediate point along the length of the handle body 331. The second taper portion 365 of the second edge bevel 341 is disposed proximal to the base cap 370. As shown in FIG. 31, the second edge bevel 341 is disposed within the top half portion 334 of the handle body 331. The second edge bevel 341 is congruent with the first edge bevel 340.

The third intermediate bevel 350 is disposed between and contiguous with the second intermediate bevel 348, the second edge bevel 341, and the second face bevel 339. The third intermediate bevel 350 is chiral and an enantiomorph of the second intermediate bevel 348 and the fourth intermediate bevel 350 and is congruent with the first intermediate bevel 342. The third intermediate bevel 350 extends the entire length of the handle body 331 from the bottom half portion of the top cap 332 through the top half portion 334 to the bottom half portion 336 of the handle body 331 and terminates at the top of the base cap 370. The second edge bevel 341 is six-sided and non-polygonal.

Figure 30:
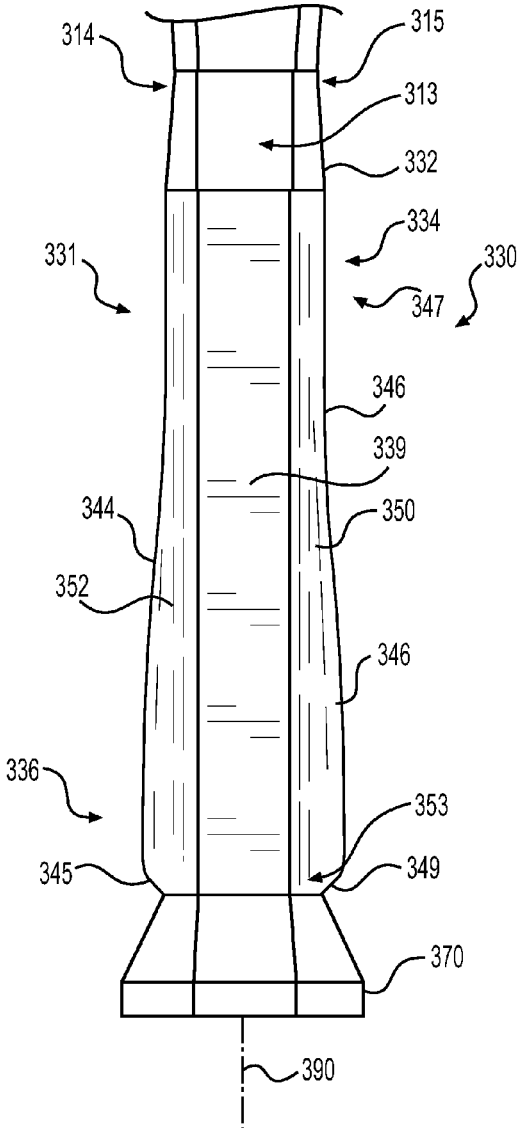
FIG. 30 is an enlarged elevation view of the second face side of the handle and a portion of the throat of the sports racket shown in FIG. 23.
Figure 32:
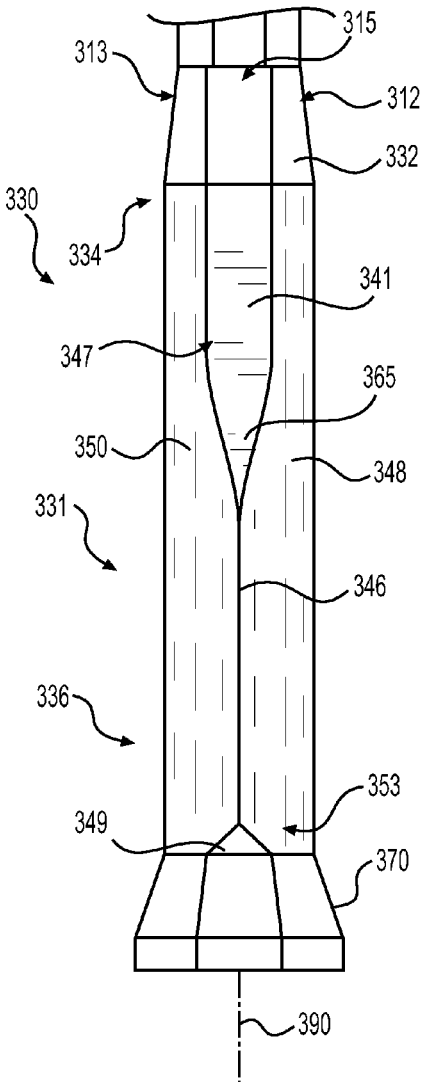
FIG. 32 is an enlarged elevation view of the second edge side of the handle and a portion of the throat of the sports racket shown in FIG. 23.
Figure 33:
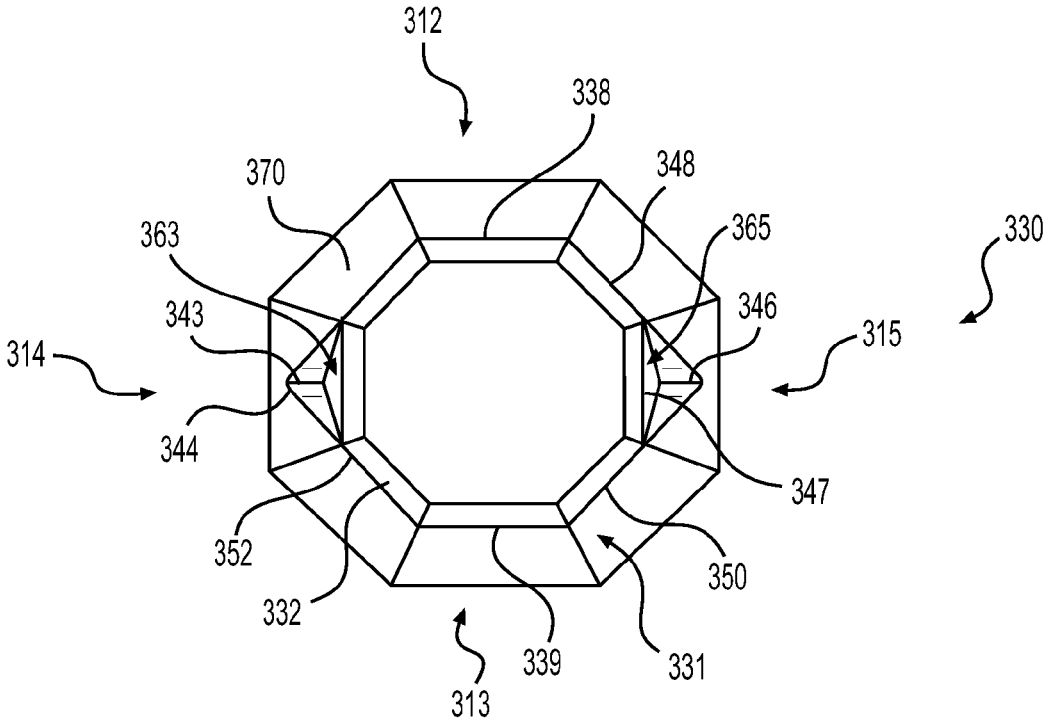
FIG. 33 is an enlarged cross-sectional view of the handle of the sports racket shown in FIG. 23 taken along line C-C of FIG. 29.
Figure 34:
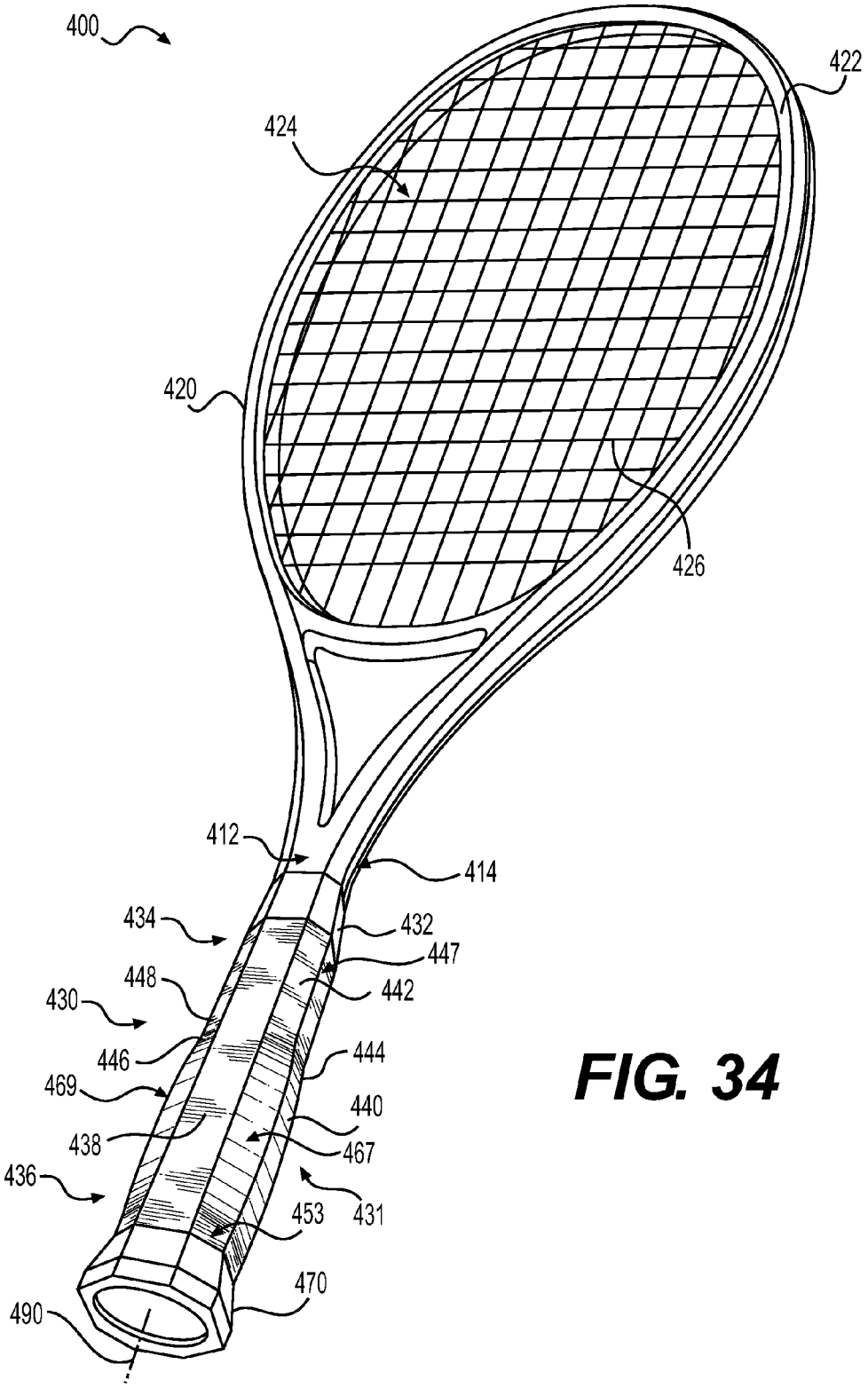
FIG. 34 is a perspective view of a still another sports racket encompassing aspects of the present disclosure.
Figure 35:
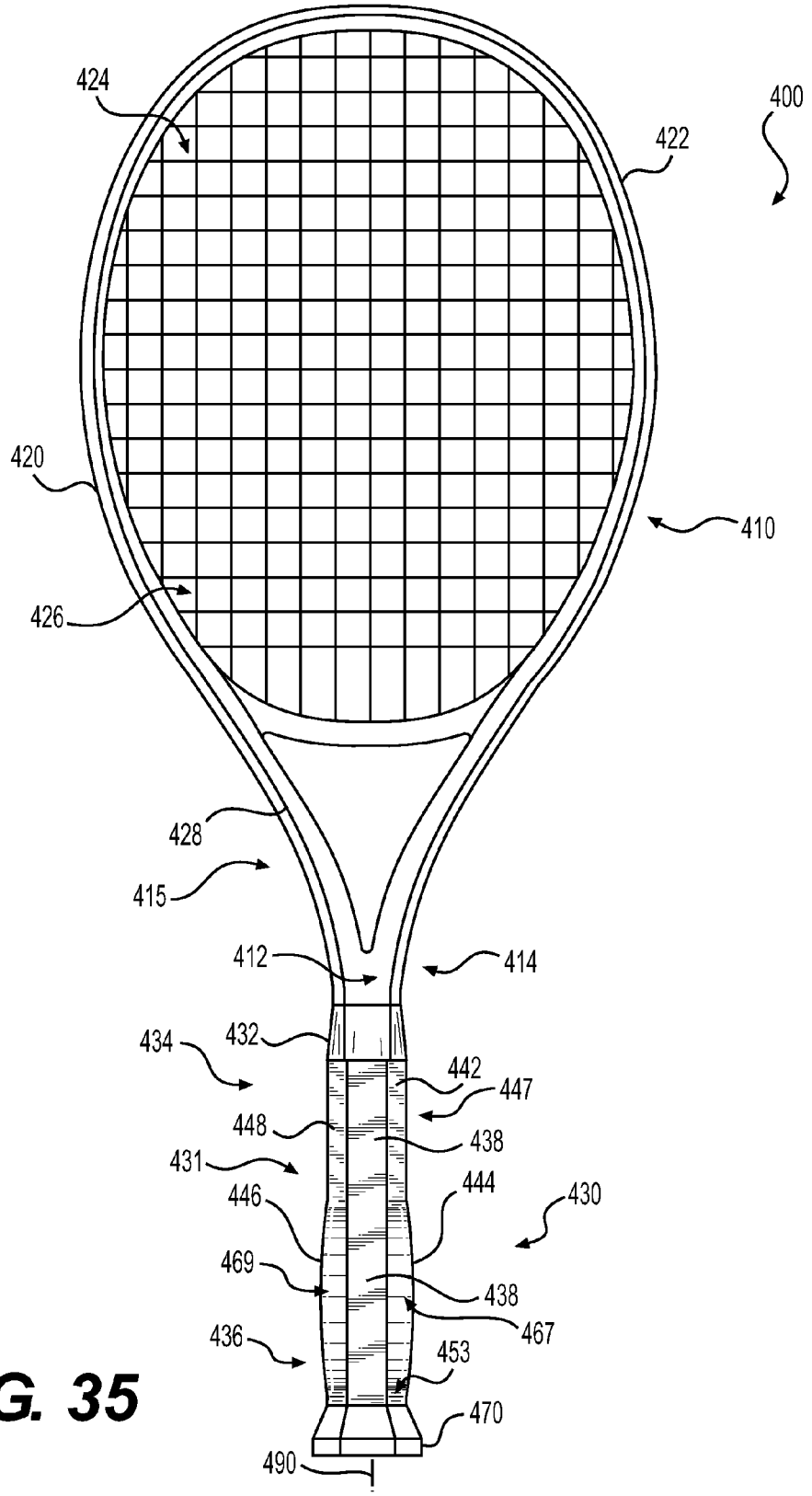
FIG. 35 is an elevation view of a first face side of the sports racket shown in FIG. 34.

As shown in FIG. 30, the handle body 331 includes a second face bevel 339 that is aligned on the second face side 313 of the frame 310 and is disposed between and contiguous with the third intermediate bevel 350 and the fourth intermediate bevel 352. Like the first face bevel 338, the second face bevel 339 is rectangular and extends the entire length of the handle body 331 from the bottom of the top cap 332 and the top of the base cap 370 and extends from the top half portion 334 through the bottom half portion 336 of the handle body 331. The second face bevel 339 is congruent with the first face bevel 338. As shown in FIGS. 31-33, the first face bevel 338 and the second face bevel 339 are both planar and aligned parallel to each other.

The fourth intermediate bevel 352 is disposed between and contiguous with the second face bevel 339, the first intermediate bevel 342 and the first edge bevel 340. The fourth intermediate bevel 352 is chiral and an enantiomorph of the first and third intermediate bevels 342 and 350 and congruent with the second intermediate bevel 348. The width of the widest portion of the fourth intermediate bevel 352 disposed in the top half portion 334 of the handle body 331 is narrower than the width of the widest portion of the fourth intermediate bevel 352 disposed in the bottom half portion 336 of the handle body 331. The edge of the fourth intermediate bevel 352 adjoining the second face bevel 339 is oblique to the edge of the fourth intermediate bevel 352 adjoining the first intermediate bevel 342. The fourth intermediate bevel 352 is six-sided, non-polygonal, and extends the entire length of the handle body 331.

The handle body 331 also comprises a first bottom edge bevel 345 disposed in the bottom half portion 336 along the first edge side 314 of the frame 310 between a portion of the first intermediate bevel 342 and a portion of the fourth intermediate bevel 352 and above the base cap 370. The first bottom edge bevel 345 is triangular and planar. On the second edge side 315 of the frame 310 is aligned a second bottom edge bevel 349, which is disposed in the bottom half portion 336 of the handle body 331 between a portion of the second intermediate bevel 348, the third intermediate bevel 350 and the base cap 370. The first bottom edge bevel 345 is aligned oblique to the second bottom edge bevel 349. The second bottom edge bevel 349 is also triangular and planar. The first and the second bottom edge bevels 345 and 349 form a waist 353 on the handle body 331 disposed in the bottom half portion 336 adjacent the base cap 370. The waist 353 has a width that is narrower than the widest portion of the bottom half portion of the handle body 331. The waist 353 and the flared sides of the base cap 370 form retention slots on the first and second edge sides 314 and 315 in which a racket user can align one or more fingers to provide leverage and grip variations as the racket 300 is used.

The racket body 331 includes a pair of shoulders disposed thereon. The first shoulder 344 is disposed on the first edge side 314 of the handle 330 and the second shoulder 346 is disposed on the second edge side 315 of the handle 330. The first and second shoulders 344 begin along an intermediate portion of the length of the handle body and flare outward. The first shoulder 344 is formed by the first and the fourth intermediate bevels 342 and 352, whereas the second shoulder 346 is formed by the second and third intermediate bevels 348 and 350. The flared first and second shoulders 344 and 346 provide a racket user a broader surface to grip in the plane extending across the face sides of the racket 300 and surface indicators for the orientation of the racket 300 within the users hand.

The racket body 331 also comprises a neck 347 disposed in the top half portion 334 of the handle body 331 between the bottom of the top cap 332 and the first and the second shoulders 344 and 346. As shown in FIGS. 24, 25, 29 and 30, the width of handle body 331 at the neck 347 is narrower than the width of the handle body 331 between the shoulders 344 and 346.

As shown in FIGS. 23-32, the first face bevel 338 and the second face bevel 339 are aligned parallel to the axis 390 extending longitudinally through the handle 330. The first shoulder 344 and the second shoulder 346 are both oblique to the axis 390, as are at least a portion of each of the first, second, third and fourth intermediate bevels 342, 348, 350, and 352.

FIGS. 34-44 show yet another sports racket 400 and parts thereof that encompass aspects of the present disclosure. The sports racket 400 includes a frame 410 that has a first face side 412, a second face 413, a first edge side 414, and a second edge side 415. The widest portions of the first and second face sides 412 and 413 are wider than the widest portions of the first and second edge sides 414 and 415. The first face side 412 is opposite to the second face side 413, as is the first edge side 414 opposite to the second edge side 415. The frame 410 also includes a head 420, a throat 428 and a handle 430. The head 420 is aligned at the top of the frame 410 and is connected to the handle 430 by the throat 428. The head 420 includes a hoop 422 that defines an aperture 424 that is open to both the first face side 412 and the second face side 413 of the frame 410. Across the aperture 424 are strung one or more strings 426 that connect to opposing points along the hoop 422.

The handle 430 includes a top cap 432 disposed at the top of the handle 430 proximal to the throat 428 and the head 420, a handle body 431 disposed below the top cap 432 distal to the throat 428 and the head 420, and a base cap 470 attached to the bottom half portion 436 of the handle body 431.

The handle body 431 of handle 430 includes a top half portion 434 that is proximal to the head 420 and a bottom half portion 436 that is distal to the head 420. The top half portion 434 is disposed adjacent the top cap 432 and the bottom half portion 436 is attached to the base cap 470. Both the top half portion 434 and the bottom half portion 436 extend one half of the length of the handle body 431 between the bottom of the top cap 432 and the top of the base cap 470. The handle body 431 comprises a plurality of bevels that form the outer surface thereof. The handle body 431 includes eight bevels that extend the entire length of the handle body 431 from the top cap 432 to the base cap 470.

The first face bevel 438 is formed on the handle body 431 and is aligned on the first face side 412 of the frame 410. The first face bevel 438 extends the entire length of the handle body 431 from the bottom of the top cap 432 to the top of the base cap 470. The first face bevel 438 is delineated by edges extending around the perimeter thereof, and is rectangular and planar with a width extending across a portion of the first face side 412 of the frame 410 and a length extending between the top cap 432 and the base cap 470.

The first intermediate bevel 442 extends the entire length of the handle body 431 from the bottom of the top cap 432 to the top of the base cap 470 through both the top half portion 434 and the bottom half portion 436 of the handle body 431. The first intermediate bevel 442 adjoins and is contiguous with both the first face bevel 438 and the first side bevel 440. A first portion of the edge of first intermediate bevel 442 that adjoins the first side bevel 440 is parallel to the edge of the first intermediate bevel 442 that adjoins the first face bevel 438, but a second portion of the edge of the first intermediate bevel 442 that adjoins the first edge bevel 440 is oblique to the edge of the first intermediate bevel 442 that adjoins the first face bevel 438. The width of the widest portion of the first intermediate bevel 442 disposed in the bottom half portion 436 of the handle body 431 is wider than the width of the widest portion of the first intermediate bevel 442 disposed in the top half portion 434 of the handle body 431. The first intermediate bevel 442 is four-sided, chiral and non-polygonal.

The first edge bevel 440 is disposed between the first intermediate bevel 442, the fourth intermediate bevel 452, the top cap 432 and the bottom cap 470. The first edge bevel 440 is disposed on the first edge side 414 of the frame 410 and includes first and second edges portions that are non-planar. The first edge bevel 440 includes a planar portion disposed in the top half portion 434 of the handle body 431 and a non-planar disposed below the planar portion distal to the head 420 of the racket 400. The first edge bevel 440 extends the entire length of the handle body 431.

The second intermediate bevel 448 is disposed between and contiguous with the first face bevel 438 and the second edge bevel 441. The second intermediate bevel 448 is chiral and an enantiomorph of both the first intermediate bevel 442 and the third intermediate bevel 450, and is congruent with the fourth intermediate bevel 452. The second intermediate bevel 448 is delineated by edges extending around the periphery thereof, and extends the entire length of the handle body 431 from the bottom half portion of the top cap 432 through the top half portion 434 to the bottom half portion 436 of the handle body 431 and terminates at the top of the base cap 470. A first portion of the edge of second intermediate bevel 448 that adjoins the second side bevel 441 is parallel to the edge of the second intermediate bevel 448 that adjoins the first face bevel 438, but a second portion of the edge of the second intermediate bevel 448 that adjoins the second edge bevel 441 is oblique to the edge of the second intermediate bevel 442 that adjoins the first face bevel 438. The width of the widest portion of the second intermediate bevel 448 disposed in the bottom half portion 436 of the handle body 431 is wider than the width of the widest portion of the second intermediate bevel 448 disposed in the top half portion 434 of the handle body 431. The second intermediate bevel 448 is four-sided and non-polygonal.

The second edge bevel 441 is disposed between and contiguous with the second intermediate bevel 448, the third intermediate bevel 450, the top cap 432 and the base cap 470. The second edge bevel 441 is disposed on the second edge side 415 of the frame 410 and includes a first edge and a second edge that are non-planar. A first portion of the second edge bevel 441 disposed in the top half portion 434 of the handle body 431 is aligned parallel to a first portion of the first edge bevel 440 disposed in the top half portion 434 of the handle body 431, whereas a second edge portion of the second edge bevel 441 is aligned oblique to a second portion of the first edge bevel 440 disposed in the bottom half portion 436 of the handle body 431. The second edge bevel 441 is congruent with the first edge bevel 440. The second edge bevel 441 is four-sided and non-planar. The second edge bevel 441 extends the entire length of the handle body 431.

The third intermediate bevel 450 is disposed between and contiguous with the second edge bevel 441, the second face bevel 439, the top cap 432 and the base cap 470. The third intermediate bevel 450 is chiral and an enantiomorph of the second intermediate bevel 448 and the fourth intermediate bevel 450 and is congruent with the first intermediate bevel 442. The third intermediate bevel 450 extends the entire length of the handle body 431 from the bottom half portion of the top cap 432 through the top half portion 434 to the bottom half portion 436 of the handle body 431 and terminates at the top of the base cap 470. A first portion of the edge of third intermediate bevel 450 that adjoins the second side bevel 441 is parallel to the edge of the third intermediate bevel 450 that adjoins the second face bevel 439, but a second portion of the edge of the third intermediate bevel 450 that adjoins the second edge bevel 441 is oblique to the edge of the third intermediate bevel 450 that adjoins the second face bevel 439. The width of the widest portion of the third intermediate bevel 450 disposed in the bottom half portion 436 of the handle body 431 is wider than the width of the widest portion of the third intermediate bevel 450 disposed in the top half portion 434 of the handle body 431. The third intermediate bevel 450 is four-sided and non-polygonal.

Figure 36:
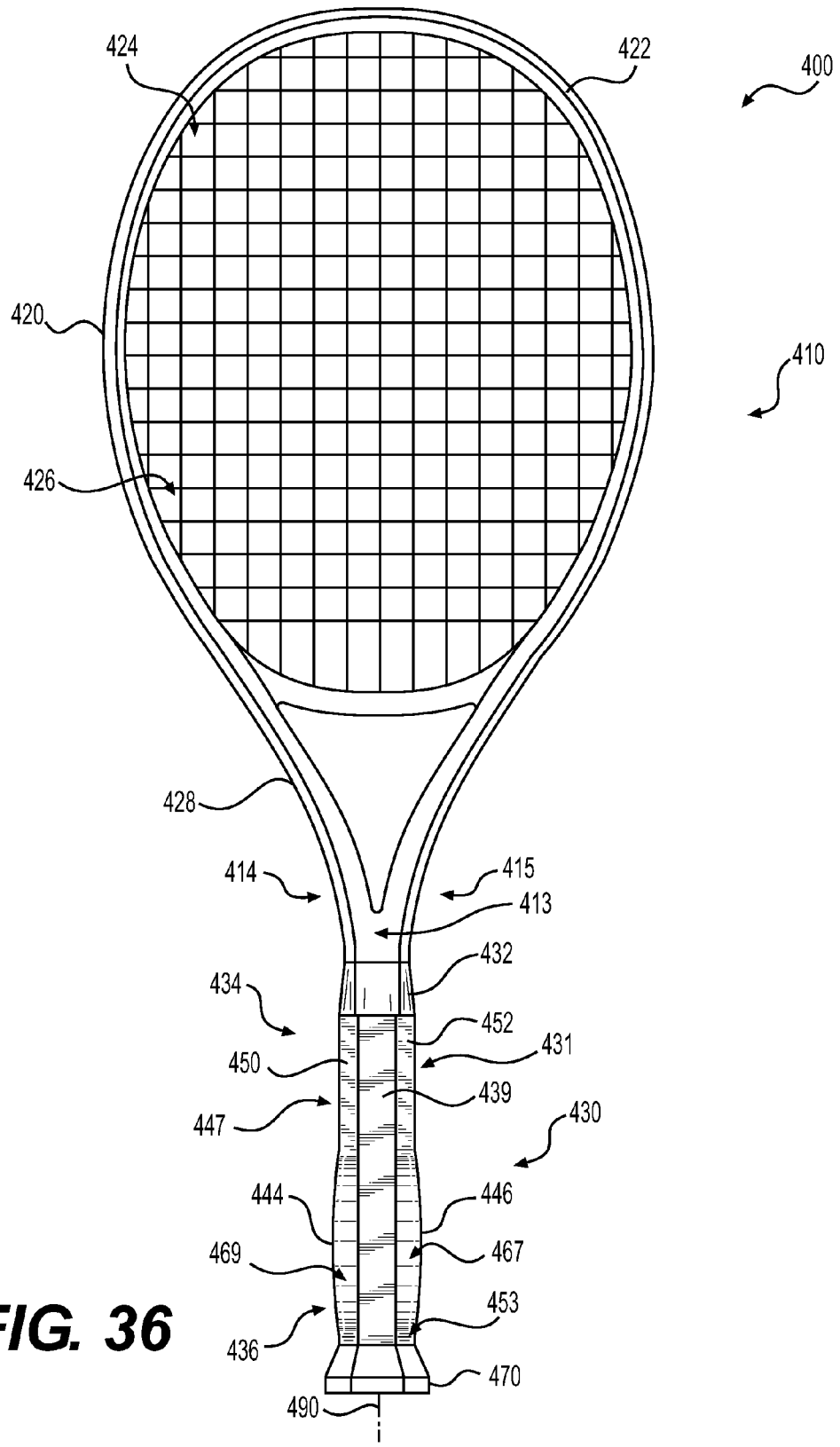
FIG. 36 is an elevation view of a second face side of the sports racket shown in FIG. 34.
Figure 37:
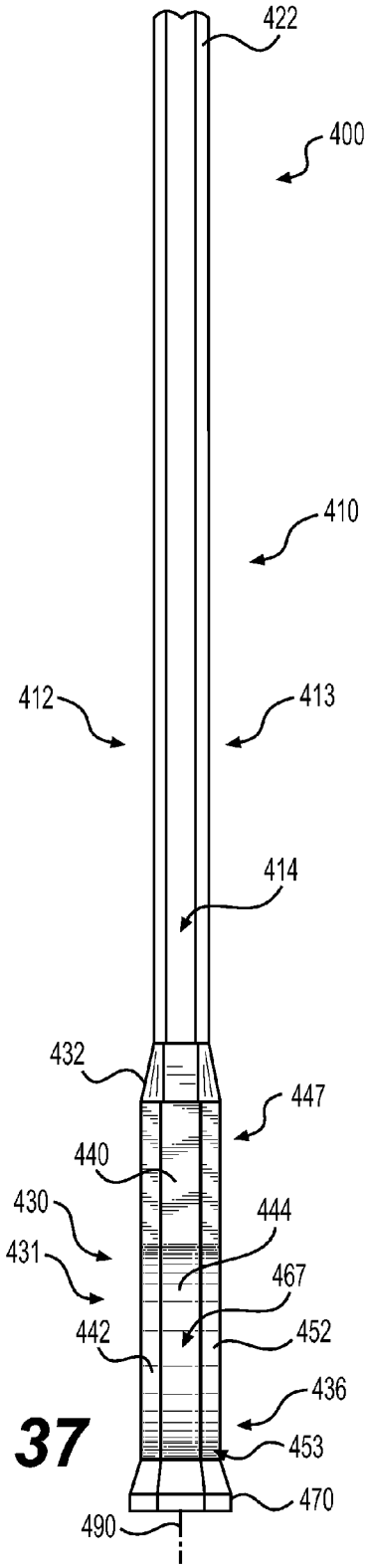
FIG. 37 is an elevation view of a first edge side of the sports racket shown in FIG. 34.
Figure 38:
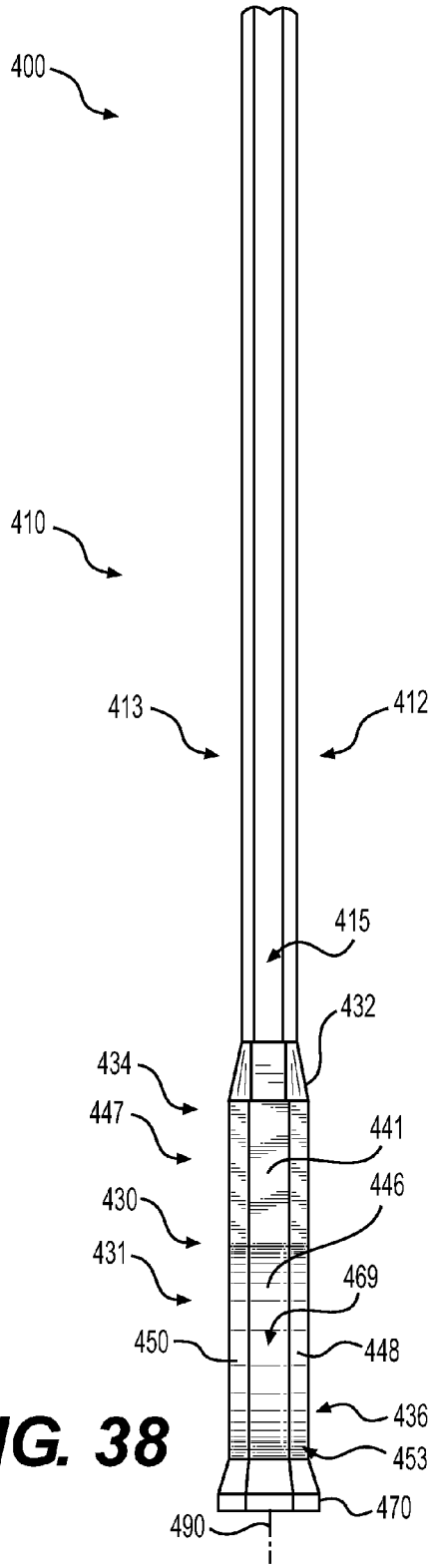
FIG. 38 is an elevation view of a second edge side of the sports racket shown in FIG. 34.
Figure 39:
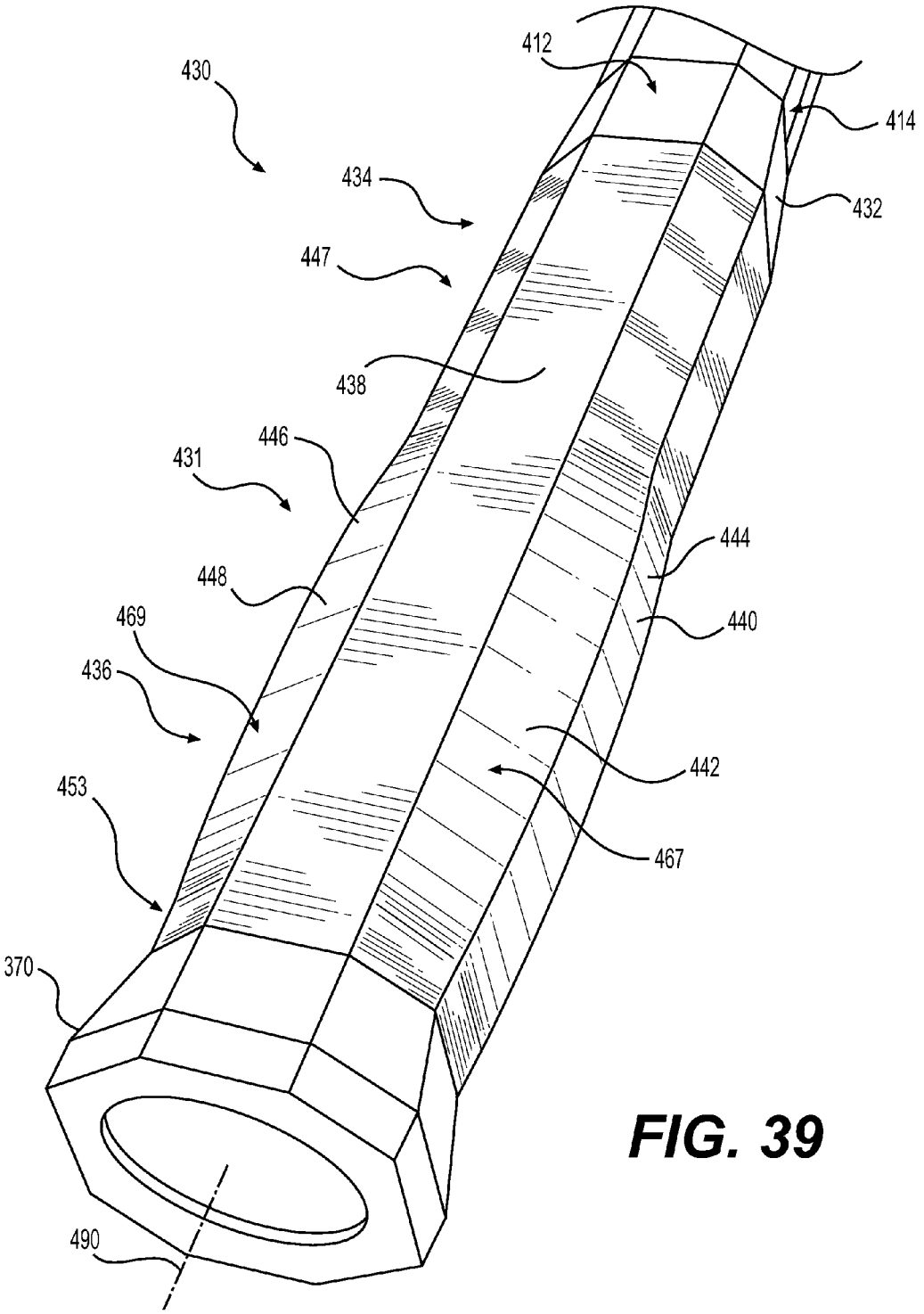
FIG. 39 is an enlarged perspective view of the handle and a portion of the throat of the sports racket shown in FIG. 34.
Figure 40:
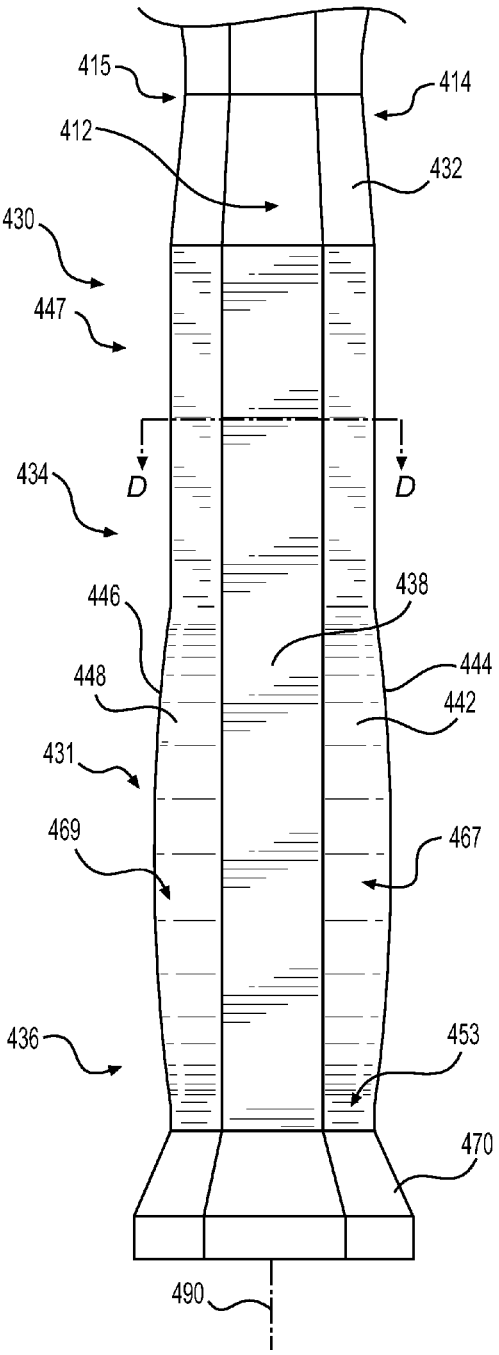
FIG. 40 is an enlarged elevation view of the first face side of the handle and a portion of the throat of the sports racket shown in FIG. 34.
Figure 41:
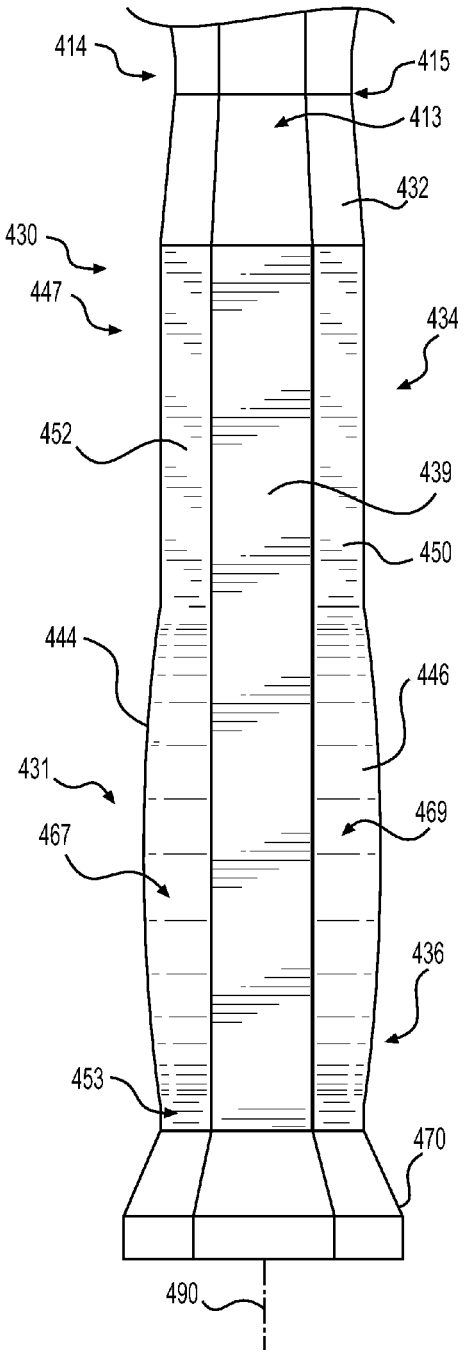
FIG. 41 is an enlarged elevation view of the second face side of the handle and a portion of the throat of the sports racket shown in FIG. 34.
Figure 42:
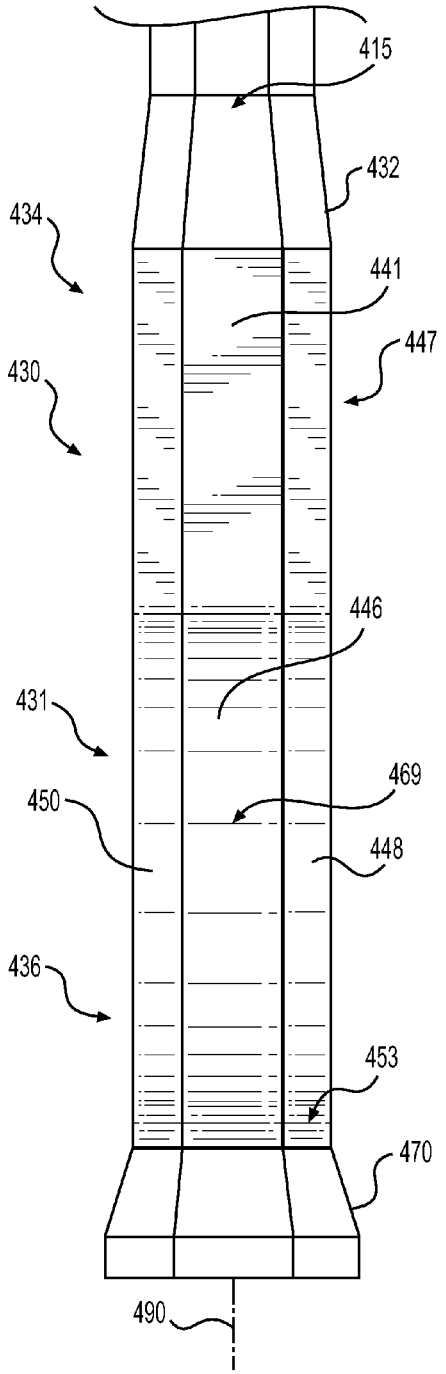
FIG. 42 is an enlarged elevation view of the first edge side of the handle and a portion of the throat of the sports racket shown in FIG. 34.
Figure 43:
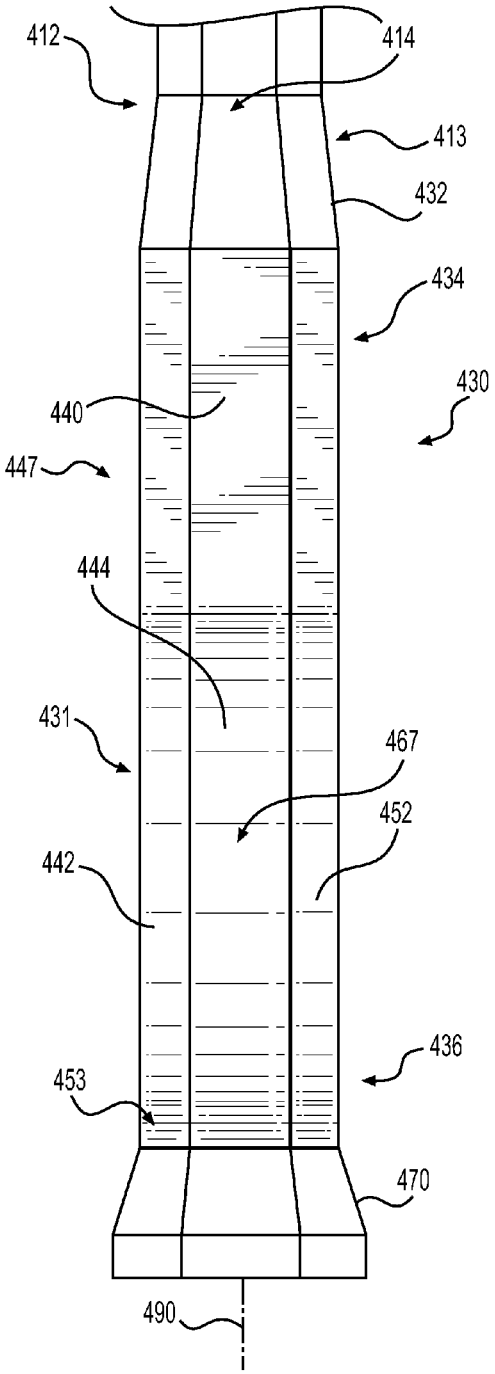
FIG. 43 is an enlarged elevation view of the second edge side of the handle and a portion of the throat of the sports racket shown in FIG. 34.
Figure 44:
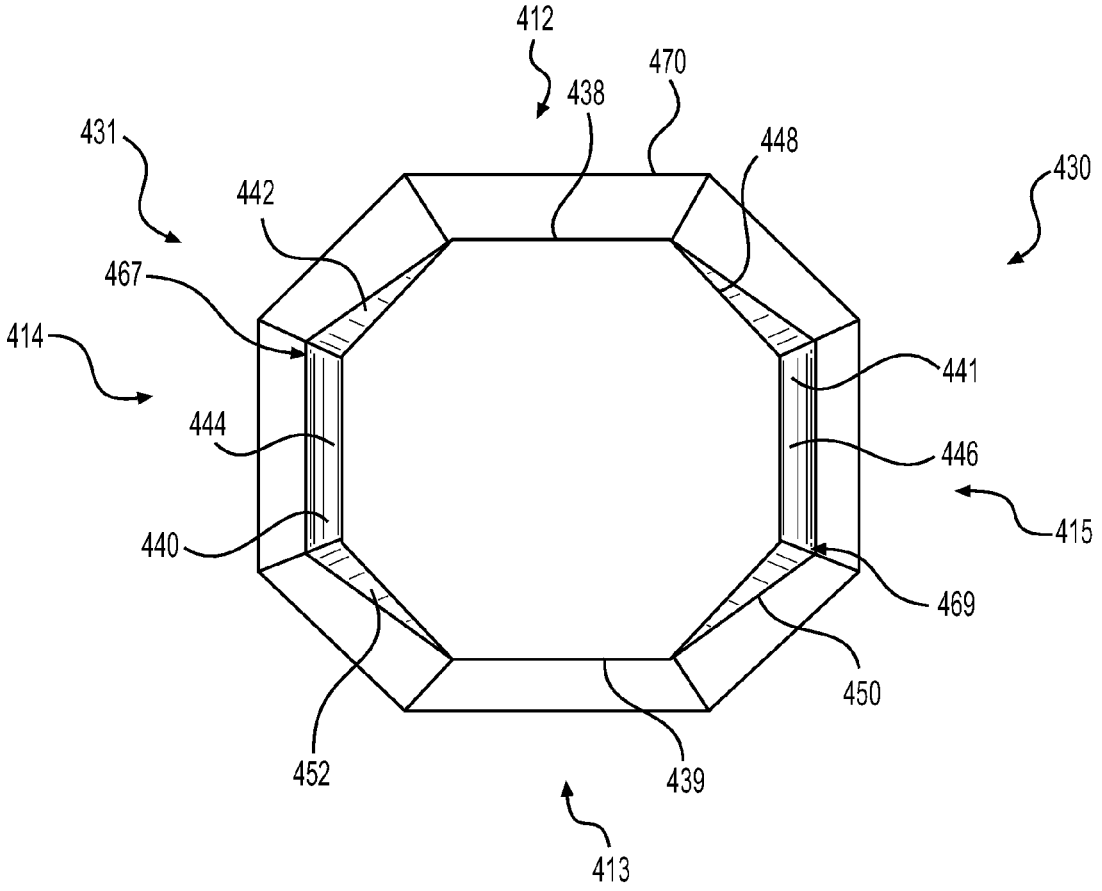
FIG. 44 is an enlarged cross-sectional view of the handle of the sports racket shown in FIG. 1 taken along line D-D of FIG. 40.

As shown in FIGS. 36 and 41, the handle body 431 includes a second face bevel 439 that is aligned on the second face side 413 of the frame 410 and is disposed between and contiguous with the third intermediate bevel 450 and the fourth intermediate bevel 452. Like the first face bevel 438, the second face bevel 439 is rectangular and disposed between the bottom of the top cap 432 and the top of the base cap 470 and extends the entire length of the handle body 431 from the top half portion 434 through the bottom half portion 436 of the handle body 431. The second face bevel 439 is congruent with the first face bevel 438. As shown in FIGS. 42 and 43, the first face bevel 438 and the second face bevel 439 are both planar and aligned parallel to each other.

The fourth intermediate bevel 452 is disposed between and contiguous with the second face bevel 439, the first edge bevel 440, the top cap 432 and the base cap 470. The fourth intermediate bevel 450 is chiral and an enantiomorph of the first and third intermediate bevel 442 and 450 and congruent with the second intermediate bevel 448. The width of the widest portion of the fourth intermediate bevel 452 disposed in the top half portion 434 of the handle body 431 is narrower than the width of the widest portion of the fourth intermediate bevel 452 disposed in the bottom half portion 436 of the handle body 431. A first portion of the edge of fourth intermediate bevel 452 that adjoins the first side bevel 440 is parallel to the edge of the fourth intermediate bevel 452 that adjoins the second face bevel 439, but a second portion of the edge of the fourth intermediate bevel 452 that adjoins the first edge bevel 440 is oblique to the edge of the fourth intermediate bevel 452 that adjoins the second face bevel 439. The fourth intermediate bevel 452 is four-sided, non-polygonal, and extends the entire length of the handle body 431.

The first intermediate bevel 442, the first edge bevel 440 and the fourth intermediate bevel 452 combine to form a first lobe 467 protruding from the first edge side 414 of the handle body 431. The second intermediate bevel 448, the second edge bevel 441, and the third intermediate bevel 450 combine to form a second lobe 469 protruding from the second edge side 415 of the handle body 431. The first lobe 467 is congruent with the second lobe 469. The first lobe 467 and the second lobe 469 are opposedly aligned on the handle body 431 and terminate within the bottom half portion 436 thereof. Between the bottom of the first and second lobes 467 and 469 and the top of the base cap 470 is disposed a waist 453 defined on the handle body 431. The width of handle body 431 at the waist 453 is narrower than the width the handle body 431 at the widest point along the first and second lobes 467 and 469 combined. The waist 453 and the flared sides of the base cap 470 form retention slots on the first and second edge sides 414 and 415 in which a racket user can align one or more fingers to provide leverage and grip variations as the racket 400 is used.

A first shoulder 444 is disposed on the first lobe 467 and a second shoulder 446 is disposed on the second lobe 469. The first shoulder 444 is disposed on the first edge side 414 of the handle 430 and the second shoulder 446 is disposed on the second edge side 415 of the handle 430. The first and second lobes 467 and 469 are disposed below the neck 447 of the handle body 431. The neck 447 is disposed between the bottom of the top cap 432 and the first and second shoulders 444 and 446. The width of the handle body 431 at the neck 447 is narrower than the width of the handle body 431 at the first and the second lobes 467 and 469. The first and second lobes 467 and 469 of the handle body 431 can provide increased surface area for contact of the user's hand on the racket 400, as compared to a conventional racket handle.

The first face bevel 438 and the second face bevel 439 are aligned parallel to the axis 490 extending longitudinally through the handle 430. The first shoulder 444 and the second shoulder 446 are both oblique to the axis 490, as are at least a portion of each of the first, second, third and fourth intermediate bevels 442, 448, 450, and 452.

In one aspect, the shoulders of the handles of the sports rackets encompassed by the present disclosure can extend along at least 25% of the length of the elongated handle bodies. In another aspect, the shoulders of the handles can extend along at least 35% of the length of the elongated handle bodies. In yet another aspect, the shoulders of the handles extend along at least 50% of the length of the elongate handle bodies. In still a further aspect, the shoulders of the handles extend along at least 80% of the length of the elongated handle bodies.

The handle bodies of the racket handles of the present disclosure can be formed of a rigid material, such as polyurethane foam; alternatively, the handle bodies can be formed of a more resilient material, such as various types of elastomers, including, for example, rubber, polybutadiene, polystyrene-polybutadiene copolymers, polyisoprene, polystyrene-polyisopreme copolymers and similar polymers and copolymers that impart the desired level of resilience. Such resilient polymeric compounds can impart shock-absorbing properties to the handle and sufficient rigidity to impart power in the racket swing.

The handle bodies of the handles of the sports rackets encompassed by the present disclosure can be formed as a single unit or can comprise more than one component combined to form the handle body. For example, the handle bodies of the present disclosure can be formed by affixing to a standard octagonal racket handle one or more attachments that, when affixed to the handle, form the bevel arrangements of the racket handles of the present disclosure.

The embodiments set forth herein are provided to illustrate the scope of the present disclosure, but are not provided to limit the scope thereof. The present disclosure contemplates alternative combinations and modifications of the features disclosed herein without departing from the scope thereof. Alternatives, variations, and modifications of the embodiments described herein will be apparent to one of ordinary skill in the art and are encompassed by the present disclosure.

What is claimed is:

1. A sports racket comprising:

a frame comprising a first face side, a second face side, a first edge side, and a second edge side, wherein the frame further comprises a head with a hoop formed therein and a handle connected to the head, wherein the handle comprises an elongated handle body comprising a plurality of bevels formed thereon, wherein the elongated handle body comprises a top half portion disposed proximal to the head and a bottom half portion disposed distal to the head, wherein the elongated handle body further comprises a first flared shoulder disposed on the first edge side and a second flared shoulder disposed on the second edge side, wherein both the first flared shoulder and the second flared shoulder extend along at least 25% of the length of the elongated handle body, and wherein at least a portion of the bottom half portion of the elongated handle body is wider than at least a portion of the top half portion of the elongated handle body.

2. The sports racket of claim 1, wherein both the first flared shoulder and the second flared shoulder extend along at least 35% of the length of the elongated handle body.

3. The sports racket of claim 1, wherein both the first flared shoulder and the second flared shoulder extend along at least 50% of the length of the elongated handle body.

4. The sports racket of claim 1, wherein both the first flared shoulder and the second flared shoulder extend along at least 80% of the length of the elongated handle body.

5. The sports racket of claim 1, wherein the elongated handle body further comprises a first lobe disposed along the first edge side.

6. The sports racket of claim 5, wherein the elongated handle body further comprises a second lobe disposed along the second edge side.

7. The sports racket of claim 1, wherein the elongated handle body further comprises a waist.

8. The sports racket of claim 7, further comprising a base cap attached to the elongated handle body, wherein the waist is disposed adjacent the base cap.

9. The sports racket of claim 1, wherein the elongated handle body further comprises a neck disposed along the top half portion.

10. The sports racket of claim 9, wherein the neck is disposed between the head and the first and the second flared shoulders.

11. The sports racket of claim 1, wherein the plurality of bevels consists of six bevels.

12. The sports racket of claim 1, wherein the plurality of bevels consists of eight bevels.

13. The sports racket of claim 1, wherein two bevels of the plurality of bevels extend along less than 75% of the length of the elongated handle body.

14. The sports racket of claim 1, wherein at least two of the plurality of bevels are parallel to each other.

15. The sports racket of claim 1, wherein at least one of the plurality of bevels is chiral and an enantiomorph of at least two of the plurality of bevels.

16. The sports racket of claim 15, wherein at least one of the plurality of bevels is congruent with at least one of the plurality of bevels.

17. A sports racket comprising:

a frame comprising a first face side, a second face side, a first edge side, and a second edge side, wherein the frame comprises a head and a handle connected to the head, wherein the head comprises a hoop with an aperture formed therein, and wherein the handle comprises a top half portion proximal to the head and a bottom half portion distal from the head, wherein the handle further comprises a first face bevel disposed on the first face side of the frame, a second face bevel disposed on the second face side of the frame, a first intermediate bevel adjoining the first face bevel and extending toward the first edge side of the frame, a second intermediate bevel adjoining the first face bevel and extending toward the second edge side of the frame, a third intermediate bevel adjoining the second face bevel and extending toward the second edge side of the frame, and a fourth intermediate bevel adjoining the second face bevel and extending toward the first edge side of the frame, wherein the first intermediate bevel extends along both the top half portion and the bottom half portion of the handle and wherein a first portion of the first intermediate bevel disposed along the bottom half portion is wider than a second portion of the first intermediate bevel disposed along the top half portion of the handle, and wherein the second intermediate bevel extends along both the top half portion and the bottom half portion of the handle and wherein a first portion of the second intermediate bevel disposed along the bottom half portion of the handle is wider than a second portion of the second intermediate bevel disposed along the top half portion of the handle.

18. The sports racket of claim 17, wherein the handle further comprises a first edge bevel disposed on the first edge side of the frame and aligned between the first intermediate bevel and the fourth intermediate bevel.

19. The sports racket of claim 18, wherein the handle further comprises a second edge bevel disposed on the second edge side of the frame and aligned between the second intermediate bevel and the third intermediate bevel.

20. The sports racket of claim 19, wherein a portion of the first edge bevel is aligned parallel to a portion of the second edge bevel.

21. The sports racket of claim 20, wherein a second portion of the first edge bevel is aligned nonparallel to the second edge bevel.

22. The sports racket of claim 17, wherein the first face bevel is aligned parallel to the second face bevel.

23. The sports racket of claim 17, wherein the third intermediate bevel extends along both the top half portion and the bottom half portion of the handle and wherein a first portion of the third intermediate bevel disposed along the bottom half portion of the handle is wider than a second portion of the third intermediate bevel disposed along the top half portion of the handle, and wherein the fourth intermediate bevel extends along both the top half portion and the bottom half portion of the handle, and wherein a first portion of the fourth intermediate bevel disposed along the bottom half portion of the handle is wider than a second portion of the fourth intermediate bevel disposed along the top half portion of the handle.

24. The sports racket of claim 17, wherein a portion of the first intermediate bevel is adjacent a portion of the fourth intermediate bevel.

25. The sports racket of claim 24, wherein a portion of the second intermediate bevel is adjacent a portion of the third intermediate bevel.

26. The sports racket of claim 25, wherein the handle further comprises a first edge bevel disposed on the first edge side of the frame and aligned between the first intermediate bevel and the fourth intermediate bevel.

27. The sports racket of claim 26, wherein the handle further comprises a second edge bevel disposed on the second edge side of the frame and aligned between the second intermediate bevel and the third intermediate bevel.

28. The sports racket of claim 27, wherein a portion of the first edge bevel is aligned parallel to a portion of the second edge bevel.

29. The sports racket of claim 17, wherein the handle further comprises a first lobe disposed along the first edge side.

30. The sports racket of claim 29, wherein the handle further comprises a second lobe disposed along the second edge side.

31. The sports racket of claim 17, wherein the handle comprises a waist.

32. The sports racket of claim 17, wherein the first intermediate bevel is chiral and an enantiomorph of the second intermediate bevel.

33. The sports racket of claim 32, wherein the first intermediate bevel is chiral and an enantiomorph of the fourth intermediate bevel.

34. The sports racket of claim 17, wherein the first intermediate bevel is congruent with the third intermediate bevel.

35. The sports racket of claim 17, wherein the first intermediate bevel is chiral and an enantiomorph of the second and the fourth intermediate bevels, and wherein the first intermediate bevel is congruent with the third intermediate bevel.

36. The sports racket of claim 35, wherein the second intermediate bevel is congruent with the fourth intermediate bevel.

37. The sports racket of claim 17, wherein the handle further comprises a neck disposed along the top half portion.

* * * * *